US009921036B2

(12) United States Patent
Gravelle et al.

(10) Patent No.: US 9,921,036 B2
(45) Date of Patent: Mar. 20, 2018

(54) FIREARM ACCESSORY MOUNT

(71) Applicant: MAGMAX, LLC, Palo Alto, CA (US)

(72) Inventors: Bruce Gravelle, Palo Alto, CA (US); James Colston Plato, Moss Beach, CA (US)

(73) Assignee: MAGMAX, LLC, Palo Alto, CA (US)

( * ) Notice: Subject to any disclaimer, the term of this patent is extended or adjusted under 35 U.S.C. 154(b) by 0 days.

(21) Appl. No.: 15/227,716

(22) Filed: Aug. 3, 2016

(65) Prior Publication Data

US 2016/0341524 A1 Nov. 24, 2016

Related U.S. Application Data

(63) Continuation of application No. 14/694,407, filed on Apr. 23, 2015, now abandoned.

(60) Provisional application No. 61/984,722, filed on Apr. 25, 2014.

(51) Int. Cl.

| | |
|---|---|
| ***F41G 11/00*** | (2006.01) |
| ***F42B 39/00*** | (2006.01) |
| ***F41C 27/00*** | (2006.01) |
| ***F41A 9/64*** | (2006.01) |

(52) U.S. Cl.

CPC ..... *F41G 11/003* (2013.01); *F41A 9/64* (2013.01); *F41C 27/00* (2013.01); *F41G 11/001* (2013.01); *F42B 39/00* (2013.01)

(58) Field of Classification Search

CPC ..... F41G 11/003; F41G 11/001; F41A 9/64; F41C 27/00; F42B 39/00

See application file for complete search history.

(56) References Cited

U.S. PATENT DOCUMENTS

| | | | |
|---|---|---|---|
| 2,931,120 | A | 4/1960 | Kolin |
| 3,386,695 | A | 6/1968 | Blood |
| 3,579,840 | A | 5/1971 | Heinzel |
| 3,750,318 | A | 8/1973 | Burris |
| 4,021,954 | A | 5/1977 | Crawford |
| 4,100,694 | A | 7/1978 | Musgrave |
| 4,115,943 | A | 9/1978 | Musgrave |
| 4,120,109 | A | 10/1978 | Musgrave |
| 4,249,315 | A | 2/1981 | Hopson, III |
| 4,442,962 | A | 4/1984 | Musgrave |
| 4,484,404 | A | 11/1984 | Johnson |
| 4,597,213 | A | 7/1986 | Musgrave |
| 4,628,627 | A | 12/1986 | Johnson |
| 4,763,151 | A | 8/1988 | Klinger |
| 4,799,323 | A | 1/1989 | Musgrave |
| 4,929,973 | A | 5/1990 | Nakatani |

(Continued)

FOREIGN PATENT DOCUMENTS

| | | |
|---|---|---|
| EP | 2247907 | 11/2010 |
| WO | WO2009095921 | 8/2009 |
| WO | WO2015164766 | 10/2015 |

*Primary Examiner* — Stephen Johnson
*Assistant Examiner* — Joshua T Semick
(74) *Attorney, Agent, or Firm* — Maywood IP Law; G. Jo Hays; David W. Meibos

(57) ABSTRACT

A system for mounting an accessory to an accessory rail of a firearm includes an accessory mount which provides a plurality of rotational positions of the accessory relative to the firearm. The accessory mount also provides one-handed insertion and removal of the accessory without touching the accessory mount. Methods of use are disclosed.

35 Claims, 20 Drawing Sheets

(56) References Cited

U.S. PATENT DOCUMENTS

| | | | | |
|---|---|---|---|---|
| 5,222,826 | A | 6/1993 | Hanke | |
| 5,636,465 | A | 6/1997 | Johnson | |
| 6,154,997 | A | 12/2000 | Aluotto | |
| 6,196,504 | B1 | 3/2001 | Lemke | |
| 6,371,424 | B1 | 4/2002 | Shaw | |
| 6,698,129 | B1 * | 3/2004 | Hanks | F41A 9/63 42/90 |
| 6,739,559 | B2 | 5/2004 | Nakatani | |
| 6,829,855 | B2 | 12/2004 | Seifert | |
| 7,562,482 | B1 | 7/2009 | Johnson | |
| 8,322,065 | B2 | 12/2012 | Faifer | |
| 8,485,405 | B2 | 7/2013 | Crye | |
| 8,640,374 | B1 * | 2/2014 | Reichelt | F41C 27/00 42/106 |
| 8,650,794 | B2 | 2/2014 | Swan | |
| 8,656,624 | B2 | 2/2014 | Holmberg | |
| 8,827,219 | B2 | 9/2014 | Kessler | |
| 8,887,977 | B2 | 11/2014 | Ralph | |
| 9,097,489 | B2 * | 8/2015 | Chiang | F42B 39/02 |
| 9,581,421 | B2 * | 2/2017 | Sitz | F42B 39/08 |
| 2003/0200693 | A1 | 10/2003 | Seifert | |
| 2007/0278269 | A1 | 12/2007 | Rogers | |
| 2009/0293334 | A1 | 12/2009 | Swan | |
| 2010/0263255 | A1 | 10/2010 | Harris | |
| 2011/0030258 | A1 | 2/2011 | Fistikchi | |
| 2011/0107645 | A1 | 5/2011 | Faifer | |
| 2012/0131829 | A1 | 5/2012 | Fistikchi | |
| 2014/0053385 | A1 | 2/2014 | Nielsen-Cole | |
| 2014/0103083 | A1 * | 4/2014 | Sitz | F42B 39/08 224/255 |
| 2015/0308790 | A1 | 10/2015 | Gravelle | |

* cited by examiner

FIREARM ACCESSORY MOUNT

CROSS-REFERENCE TO RELATED APPLICATIONS

The present application is a continuation of:

U.S. patent application Ser. No. 14/694,407, entitled FIREARM ACCESSORY MOUNT, which was filed on Apr. 23, 2015.

U.S. patent application Ser. No. 14/694,407 claims the benefit of:

U.S. Provisional Application No. 61/984,722, entitled FIREARM ACCESSORY MOUNT, which was filed on Apr. 25, 2014.

The foregoing are incorporated by reference as though set forth herein in their entirety.

BACKGROUND

This disclosure relates to a mounting system for coupling an accessory, such as a spare magazine, to a firearm.

SUMMARY

A system for mounting an accessory on an accessory rail of a firearm includes an accessory holder. The accessory holder includes a U-shaped channel. The U-shaped channel includes a first wall, a second wall opposite to the first wall, and a third wall connecting the first wall to the second wall. An interior surface of the first wall carries a first detent. An exterior surface of the second wall couples to the accessory rail and locks to the accessory rail. The U-shaped channel receives the accessory. The first detent retains the accessory in the U-shaped channel.

Embodiments of the system may have at least some of the following attributes. The second wall is parallel to the first wall. The first wall and the second wall each have a free end opposite to the third wall. The second wall forms an acute angle with the first wall. The acute angle opens toward the third wall so that the free ends of the first and second walls converge. The first detent protrudes into an interior space of the U-shaped channel. The U-shaped channel includes an open side opposite to the third wall, an open first end, a second end opposite to the first end, and a fourth wall. The fourth wall closes off at least a portion of the second end. The fourth wall is separated from the first wall by a slot. The accessory is a magazine. When the U-shaped channel receives the magazine, a feed lip of the magazine is adjacent to the fourth wall. The exterior surface of the second wall carries a clamp. The clamp receives the accessory rail and locks the accessory holder to the accessory rail. The exterior surface of the second wall includes a holder fitting. The holder fitting includes a central axis. The clamp includes a first side that faces the holder fitting. The first side of the clamp includes a clamp fitting which is complementary to the holder fitting. The clamp fitting couples to the holder fitting in at least three discrete rotational positions about the central axis of the holder fitting. The at least three discrete rotational positions are at 90 degree intervals. The holder fitting includes an outwardly flared square protrusion. The clamp fitting includes a first tooth and a second tooth opposite to the first tooth. The outwardly flared square protrusion is received between the first and second teeth. The clamp includes a second side that faces the accessory rail. The second side of the clamp includes a rail fitting which is complementary to the accessory rail. The rail fitting receives the accessory rail and locks the clamp to the accessory rail. The rail fitting includes a third tooth and a fourth tooth opposite to the third tooth. The accessory rail is received between the third and fourth teeth. When the outwardly flared square protrusion is received and locked between the first and second teeth, a distance between the first and second teeth is greater than a distance between the third and fourth teeth.

Another system for mounting an accessory on an accessory rail of a firearm includes an accessory holder. The accessory holder includes a U-shaped channel. The U-shaped channel includes a first wall, a second wall opposite to the first wall, and a third wall connecting the first wall to the second wall. An interior surface of the U-shaped channel carries a first detent. An exterior surface of the U-shaped channel couples to the accessory rail and locks to the accessory rail. The U-shaped channel receives the accessory. The first detent retains the accessory in the U-shaped channel.

Embodiments of the system may have at least some of the following attributes. The second wall is parallel to the first wall. The first wall and the second wall each have a free end opposite to the third wall. The second wall forms an acute angle with the first wall. The acute angle opens toward the third wall so that the free ends of the first and second walls converge. The first detent protrudes into an interior space of the U-shaped channel. The U-shaped channel includes an open side along the first and second walls opposite to the third wall, an open first end, a second end opposite to the first end, and a fourth wall. The fourth wall closes off at least a portion of the second end. The fourth wall is separated from the first wall by a slot. The accessory is a magazine. When the U-shaped channel receives the magazine, a feed lip of the magazine is adjacent to the fourth wall. The exterior surface of the U-shaped channel carries a clamp. The clamp receives the accessory rail and locks the accessory holder to the accessory rail. The exterior surface of the U-shaped channel includes a holder fitting. The holder fitting includes a central axis. The clamp includes a first side that faces the holder fitting. The first side of the clamp includes a clamp fitting which is complementary to the holder fitting. The clamp fitting couples to the holder fitting in at least three discrete rotational positions about the central axis of the holder fitting. The at least three discrete rotational positions are at 90 degree intervals. The holder fitting includes an outwardly flared square protrusion. The clamp fitting includes a first tooth and a second tooth opposite to the first tooth. The outwardly flared square protrusion is received between the first and second teeth. The clamp includes a second side that faces the accessory rail. The second side of the clamp includes a rail fitting which is complementary to the accessory rail. The rail fitting receives the accessory rail and locks the clamp to the accessory rail. The rail fitting includes a third tooth and a fourth tooth opposite to the third tooth. The accessory rail is received between the third and fourth teeth. When the outwardly flared square protrusion is received and locked between the first and second teeth, a distance between the first and second teeth is greater than a distance between the third and fourth teeth.

Yet another system for mounting an accessory on an accessory rail of a firearm includes an accessory holder. The accessory holder includes a U-shaped channel. The U-shaped channel includes a first wall, a second wall opposite to the first wall, and a third wall connecting the first wall to the second wall. The first wall and the second wall each have a free end opposite to the third wall. The U-shaped channel carries a first detent. An exterior surface of the U-shaped channel couples to the accessory rail. The U-shaped channel receives the accessory. The first detent retains the accessory in the U-shaped channel.

Embodiments of the system may have at least some of the following attributes. The second wall is parallel to the first wall. The second wall forms an acute angle with the first wall. The acute angle opens toward the third wall so that the free ends of the first and second walls converge. An interior surface of the U-shaped channel carries the first detent. The first detent protrudes into an interior space of the U-shaped channel. The U-shaped channel includes an open side along the free ends of the first and second walls, an open first end, a second end opposite to the first end, and a fourth wall. The fourth wall closes off at least a portion of the second end. The fourth wall is separated from the first wall by a slot. The accessory is a magazine. When the U-shaped channel receives the magazine, a feed lip of the magazine is adjacent to the fourth wall. The exterior surface of the U-shaped channel carries a clamp. The clamp receives the accessory rail and locks the accessory holder to the accessory rail. The exterior surface of the U-shaped channel includes a holder fitting. The holder fitting includes a central axis. The clamp includes a first side that faces the holder fitting. The first side of the clamp includes a clamp fitting which is complementary to the holder fitting. The clamp fitting couples to the holder fitting in at least three discrete rotational positions about the central axis of the holder fitting. The at least three discrete rotational positions are at 90 degree intervals. The holder fitting includes an outwardly flared square protrusion. The clamp fitting includes a first tooth and a second tooth opposite to the first tooth. The outwardly flared square protrusion is received between the first and second teeth. The clamp includes a second side that faces the accessory rail. The second side of the clamp includes a rail fitting which is complementary to the accessory rail. The rail fitting receives the accessory rail and locks the clamp to the accessory rail. The rail fitting includes a third tooth and a fourth tooth opposite to the third tooth. The accessory rail is received between the third and fourth teeth. When the outwardly flared square protrusion is received and locked between the first and second teeth, a distance between the first and second teeth is greater than a distance between the third and fourth teeth.

BRIEF DESCRIPTION OF THE DRAWINGS

The scope of the technology will become more fully apparent from the following description and appended claims, taken in conjunction with the accompanying drawings. These drawings depict examples only and are therefore not to be considered limiting of the scope of the technology.

DETAILED DESCRIPTION

Examples of the technology will be best understood by reference to the drawings, wherein like parts are designated by like numerals throughout. While the various aspects of the embodiments are presented in drawings, the drawings are not necessarily drawn to scale unless specifically indicated. It will be readily understood that the components of the technology, as generally described and illustrated in the figures herein, could be arranged and designed in a wide variety of different configurations. Thus, the following more detailed description of the embodiments of the apparatus, systems, and methods is not intended to limit the scope of the invention, as claimed in this or any other application claiming priority to this application, but is merely representative of examples of the technology.

The phrases "connected to," "coupled to" and "in communication with" refer to any form of interaction between two or more entities, including mechanical, electrical, magnetic, electromagnetic, fluid, and thermal interaction. Two components may be functionally coupled to each other even though they are not in direct contact with each other.

The term "abutting" refers to items that are in direct physical contact with each other, although the items may not necessarily be attached together.

The phrase "fluid communication" refers to two features that are connected such that a fluid within one feature is able to pass into the other feature.

The word "exemplary" is used herein to mean "serving as an example, instance, or illustration." Any embodiment described herein as "exemplary" is not necessarily to be construed as preferred or advantageous over other embodiments.

While the following disclosure is made in the context of using the accessory mounts as spare magazine holders, the accessory mounts are adaptable to other firearm accessories.

Figure 1:
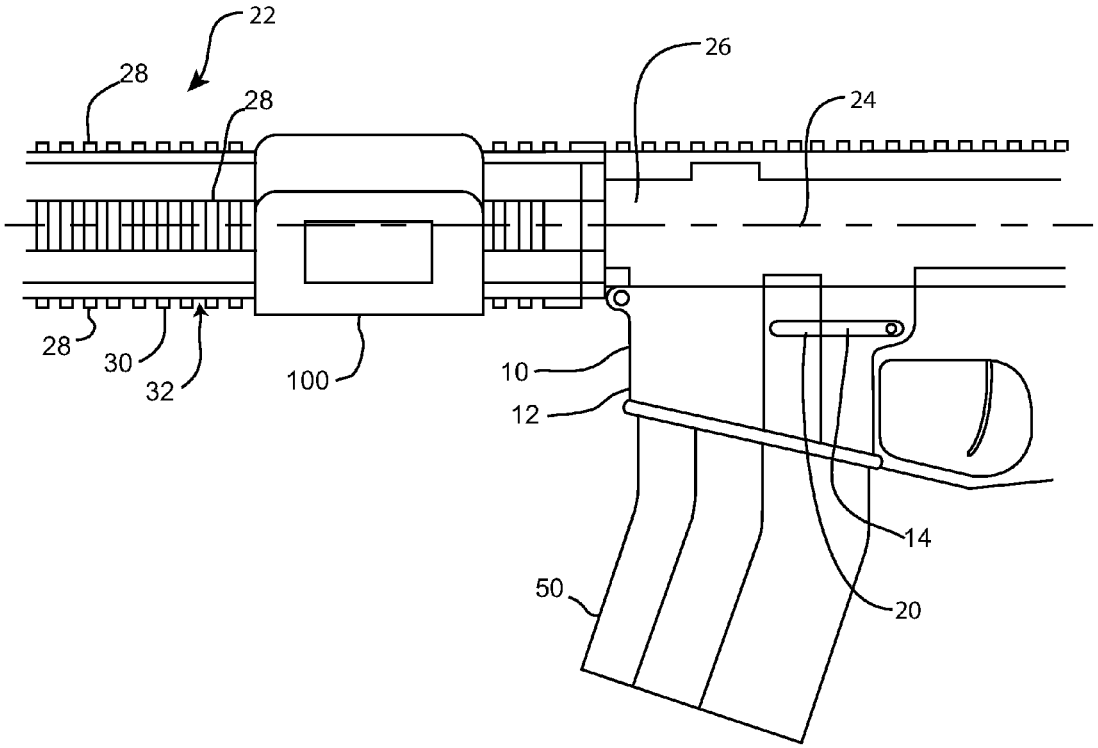
FIG. 1 is a left side view of a central portion of a firearm with a magazine secured in a magazine well of the firearm and an accessory mount secured to an accessory rail of the firearm.

Referring to FIG. 1, a firearm 10, a detachable ammunition magazine 50, and an accessory mount 100 are shown coupled together in a left side view showing a central portion of the firearm 10. The firearm 10 may be a long gun, such as a rifle or shotgun, or it may be a handgun. The ammunition magazine 50 is complementary to the make and model of the firearm 10. For the purposes of illustration, FIG. 1 shows an AR-15 rifle with a complementary ammunition magazine. Various embodiments of the disclosed technology enable its use with a wide variety of firearms and magazine types.

As illustrated in FIG. 1, the firearm 10 includes a magazine well 12, a magazine locking mechanism 14, a barrel 22 having a central longitudinal axis 24, an upper receiver 26, and an accessory rail 28. Three accessory rails are visible in FIG. 1, and a fourth accessory rail may be present along the right side of the firearm 10, although not visible in FIG. 1.

The magazine well 12 receives the magazine 50 and holds the magazine 50 securely in position to feed cartridges 90 (FIG. 9) into the firearm 10 for firing.

The magazine locking mechanism 14 is associated with the magazine well 12 and secures the magazine 50 in the magazine well 12. The magazine locking mechanism 14 includes a magazine catch 20, a magazine release button (not shown) which is exposed for actuation by a user, and a magazine detent (not shown) which protrudes into the interior of the magazine well 12 to engage the magazine 50. In the illustrated example, the magazine release button happens to be located on the right side of the firearm 10. The magazine catch 20 carries the magazine detent and may also carry the magazine release button. Typically, the magazine locking mechanism 14 is biased to automatically retain the magazine 50 when the magazine 50 is introduced into the magazine well 12 in the proper orientation. The magazine locking mechanism 14 is actuated by the user to release the magazine 50. In the example shown, actuation involves pressing the magazine release button on the right side of the firearm 10, which moves the magazine detent on the left side of the firearm 10 laterally (i.e., outboard or left) out of engagement with the magazine 50.

The accessory rail 28 is connected to the firearm 10 to provide a mounting location for various accessories, such as scopes, tactical lights, laser aiming modules, night vision devices, reflex sights, foregrips, bipods, bayonets, magazines, or electronic devices. The accessory rail 28 may be coupled to the firearm 10 at any location. Examples of accessory rail locations include the foregrip, the upper receiver, the stock, or, in the case of a handgun, the frame, the grip, or the slide. The barrel 22 of the firearm 10 has a center longitudinal axis 24 which is the axis along which a bullet travels after being fired. The accessory rail 28 may be parallel to the center longitudinal axis 24 of the barrel 22. While it is common for an accessory rail 28 to be coupled to the firearm 10 parallel to the barrel 22, other orientations of the rail 28 to the axis 24 are contemplated. The illustrated example shows a long accessory rail 28 extending parallel to the barrel 22 along at least a portion of the barrel 22 and at least a portion of the upper receiver 26, plus two additional shorter accessory rails 28 extending parallel to the barrel 22 beside and below the barrel 22. A fourth accessory rail (not visible in this view) may be provided along the right side of the barrel 22.

The accessory rail 28 may provide discrete or continuous mounting locations, or a combination of discrete and continuous mounting locations. Examples of discrete mounting locations include a pattern of alternating ridges 30 and grooves 32, or a pattern of threaded features (not shown). Accessories may be mounted to these discrete locations by attaching to a particular ridge 30 or groove 32, or by threaded connection to a particular threaded feature. Examples of continuous mounting locations include dovetail or T rails in which the dovetail or T-shaped cross sectional shape extends the length of the rail; other cross sectional geometries with comparable undercut geometry may be provided instead of a dovetail or T-shape. Accessories may be mounted to these continuous mounting locations, or mounting features, by providing the accessories with an undercut cross sectional shape complementary to the dovetail, T-shape, or other undercut shape of the accessory rail 28; and a fastener that, when actuated, fixes the accessory in a particular location along the accessory rail 28. When the fastener is not engaged, the accessory is free to slide along the rail 28 to any location. Examples of combined discrete and continuous mounting locations include the Weaver rail, Picatinny rail, MIL-STD-1913 rail, STANAG 2324 rail, tactical rail, or NATO rail. The accessory rails 28 shown in the example are Picatinny rails.

Figure 2:
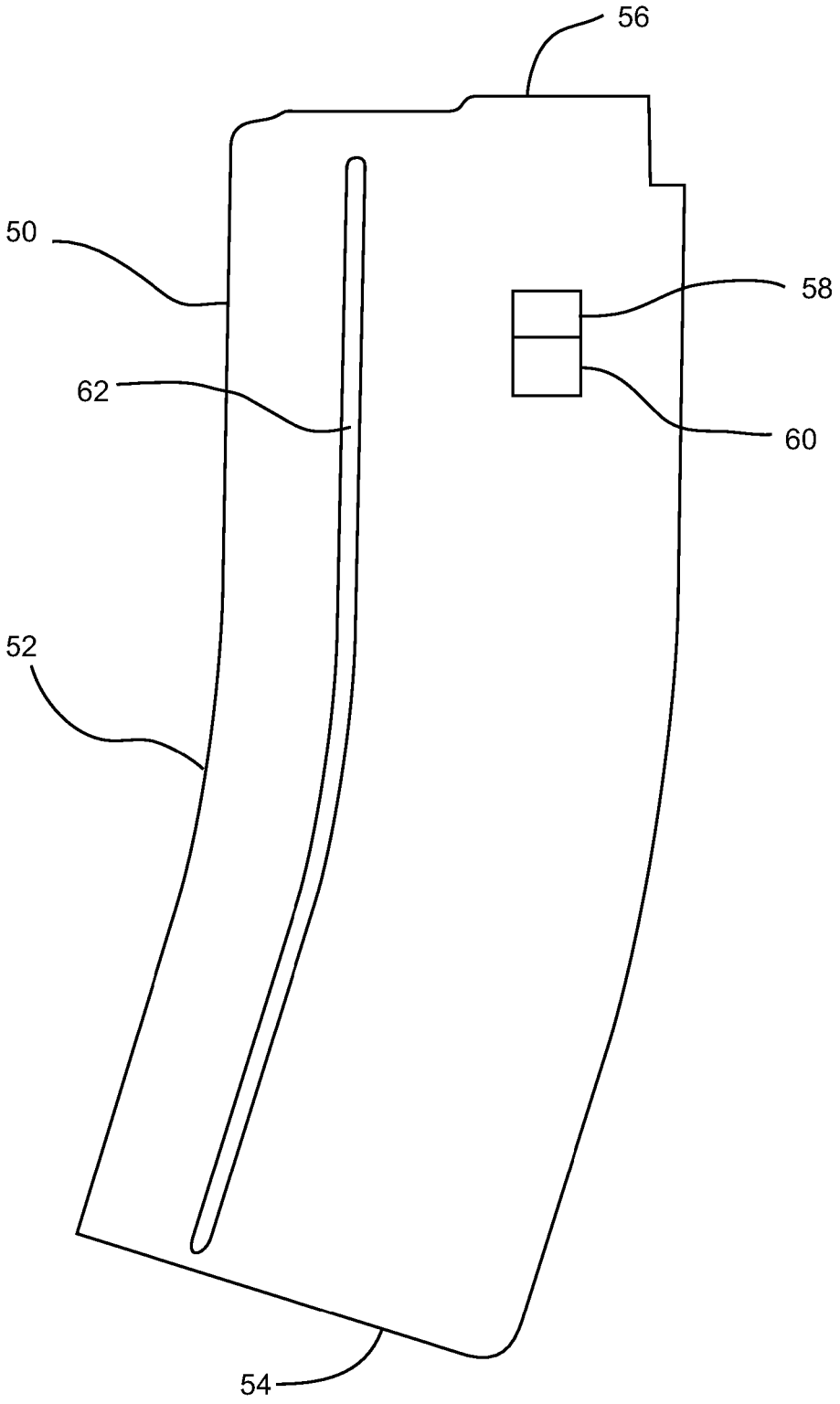
FIG. 2 is a left side view of the magazine of FIG. 1.

Referring to FIG. 2, the detachable ammunition magazine 50 includes a hollow receptacle 52, a base plate 54, a feed lip 56, and a first detent 58. The magazine 50 will serve throughout this disclosure as one example of an accessory for a firearm, although the technology is adaptable to other firearm accessories.

The hollow receptacle 52 receives cartridges 90 (FIG. 9) for the firearm 10. The hollow receptacle 52 may be a tubular part with a rectangular cross section and an arcuate or rectangular profile. An arcuate profile is illustrated in FIGS. 1 and 2. At one open end of the hollow receptacle 52, the base plate 54 closes off at least a portion of the hollow receptacle 52. At a second open end of the hollow receptacle 52 opposite the base plate 54, the hollow receptacle 52 is formed into one or more feed lips 56. Cartridges 90 enter and exit the hollow receptacle 52 through the second open end with the feed lip(s) 56.

The first detent 58 engages the magazine detent of the magazine locking mechanism 14 of the firearm 10 when the magazine 50 is inserted into the magazine well 12. The first detent 58 may be recessed beneath, or protrude above, the nominal outer surface of the hollow receptacle 52; in some instances first detent 58 may be a hole or window. The magazine 50 may include a second detent 60. The second detent 60 may be recessed beneath, or protrude above, the nominal outer surface of the hollow receptacle 52; in some instances second detent 60 may be a hole or window. Second detent 60 may be located adjacent to first detent 58, or elsewhere on the magazine 50. Second detent 60 is illustrated next to first detent 58, with first detent 58 between second detent 60 and the feed lip(s) 26. In some instances, second detent 60 may be an opposite feature to first detent 58. For example, if first detent 58 is a recess or a hole, then second detent 60 may be a protrusion, or vice versa. In the illustrated example, first detent 58 is a recess or a hole and second detent 60 is a protrusion. Another feature of the magazine 50, such as longitudinal groove 62, may act as a third detent.

The accessory mount 100 may be an assembly including an accessory holder 102, a fastener 2, and a clamp assembly 176. This example may be suitable for use as a spare magazine holder, carrier, or mount, and will be described in that context even though this accessory mount 100 may be suitable for use with other firearm accessories.

Figure 3A:
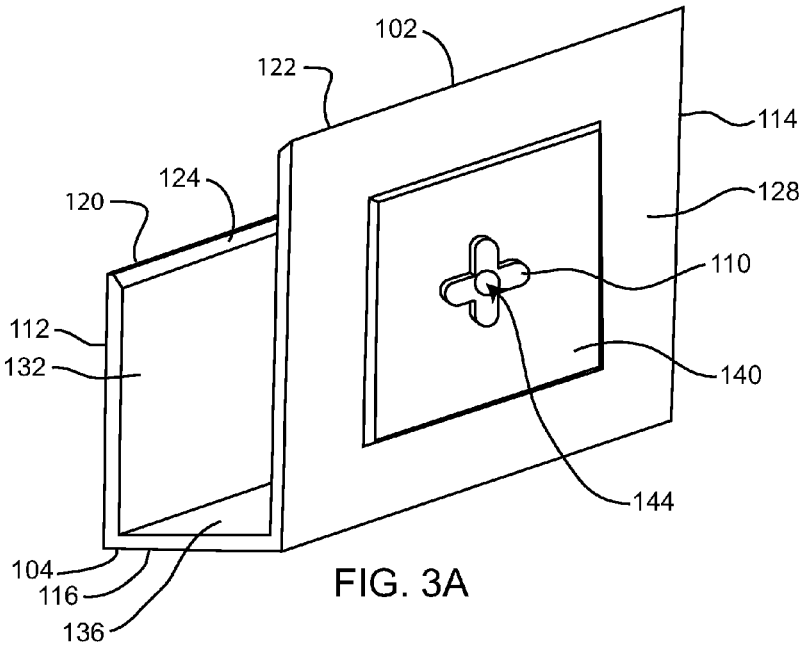
FIG. 3A is a right isometric view of an accessory holder of the accessory mount of FIG. 1.
Figure 3B:
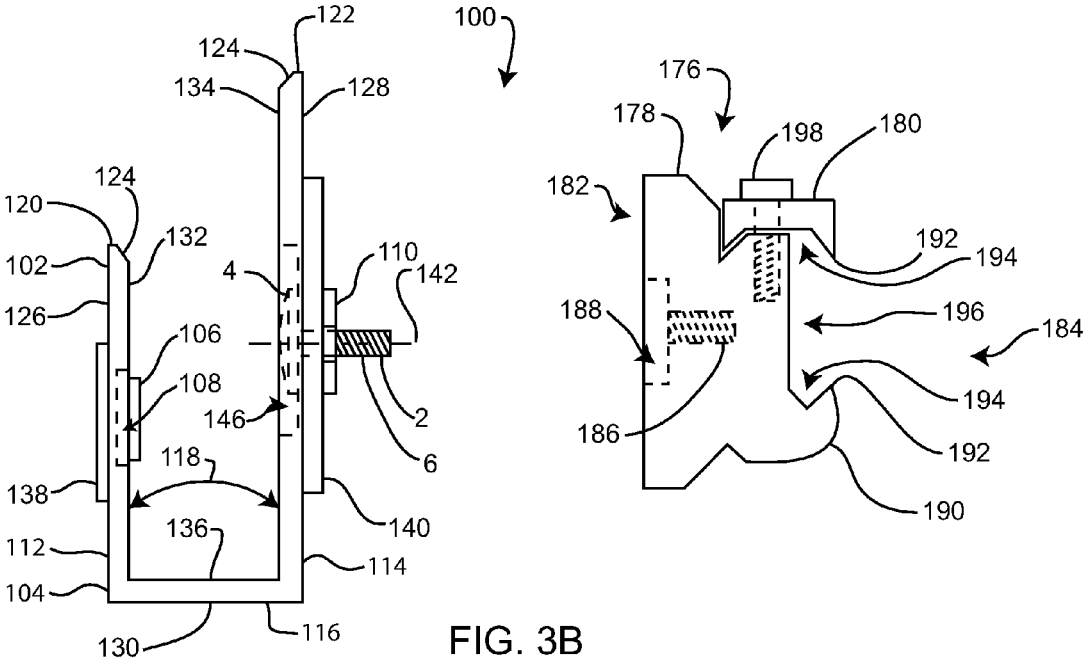
FIG. 3B is an exploded end view of the accessory mount of FIG. 1 showing the accessory holder of FIG. 3A with a clamp assembly.

Referring to FIGS. 3A and 3B, the accessory holder 102 may include a U-shaped channel 104, a first detent 106, and a fitting 110.

The U-shaped channel 104 includes a first wall 112 and a second wall 114 opposite to the first wall 112. The second wall 114 may be parallel to the first wall 112, or the second wall 114 may form an acute angle 118 of up to ±45 degrees with the first wall 112. Angle 118 is indicated in FIG. 3B. The magnitude of angle 118 may be zero degrees, or angle 118 may be non-zero so that the walls 112, 114 converge or diverge at their free ends 120, 122. The U-shaped channel 104 has an open side along the free ends 120, 122. The free ends 120, 122 of the first and second walls 112, 114 may include chamfers 124 or another kind of lead-in feature or edge break feature. A third wall 116 may connect the first wall 112 to the second wall 114 opposite the free ends 120, 122. In the illustrated example, the third wall 116 forms distinct square corners with the first wall 112 and the second wall 114; in other examples, these corners may be rounded so that the third wall 116 blends with the first wall 112 and the second wall 114, or is indistinguishable due to a full radius between the first wall 112 and the second wall 114. Each wall 112, 114, 116 has an exterior surface, designated 126, 128, 130 respectively; and an interior surface, designated 132, 134, 136 respectively.

The first detent 106 is located on the interior surface 132 of the first wall 112, and may protrude above, or be recessed beneath, the nominal interior surface; in some instances first detent 106 may be a hole or window. In the example, first detent 106 protrudes into the interior space of the U-shaped channel 104 to engage the first detent 58 of magazine 50.

The first detent 106 is biased to automatically retain the magazine 50 by engaging the first detent 58 when the magazine is introduced into the U-shaped channel 104. The magazine 50 may be retained without direct or indirect user actuation of the first detent 106 (for example, without pressing a button or lever) and may be retained without the user touching the accessory mount 100 at all, only touching the portion of the magazine 50 that protrudes past the accessory mount 100. Bias may be provided by the inherent resilience of the first wall 112 or the U-shaped channel 104, or by a spring element, such as a flat spring or a torsion spring. In an alternate example, the first detent 106 may be bounded on all but one side by a slit (not shown) which separates the first detent 106 from the rest of the first wall 112 so that the first detent 106 is carried on a cantilever tab; in this example, bias may be provided by the inherent resilience of the cantilever tab, or by a spring element that forms the cantilever tab and/or the first detent 106.

The first detent 106 also automatically releases the magazine 50 when the magazine is removed from the U-shaped channel 104. The magazine 50 may be released without direct or indirect user actuation of the first detent 106 (for example, without pressing a button or lever) and may be released without the user touching the accessory mount 100 at all, only touching the portion of the magazine 50 that protrudes past the accessory mount 100.

Figure 6:
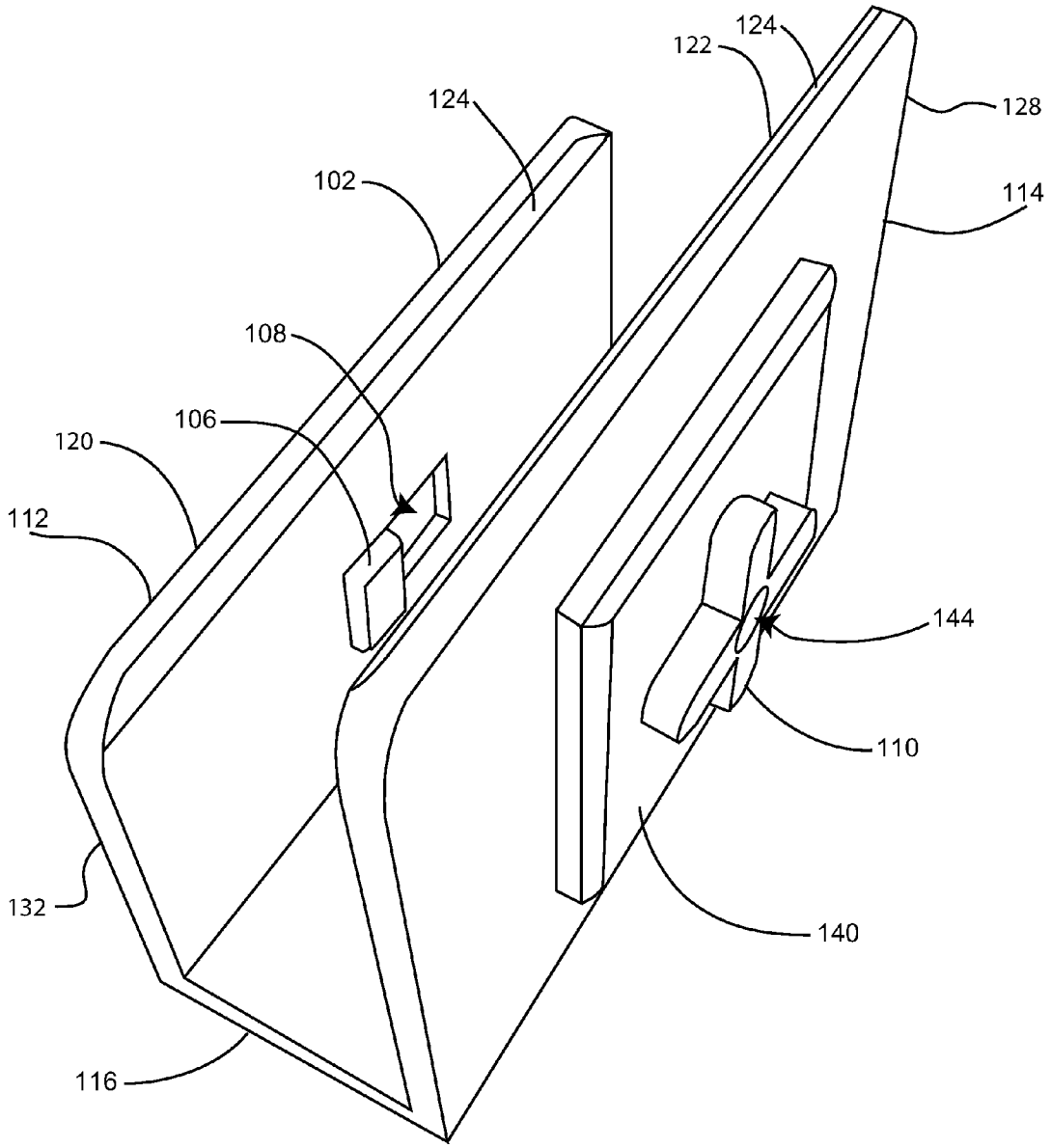
FIG. 6 is yet another right isometric view of the accessory holder of FIG. 1.

The accessory holder 102 may include a second detent 108 (FIG. 6). The second detent 108 may protrude above, or be recessed beneath, the nominal interior surface 132; in some instances second detent 108 may be a hole or window. Second detent 108 may be located adjacent to first detent 106, or elsewhere on the accessory holder 102. Second detent 108 is illustrated next to first detent 106. In some instances, second detent 108 may be an opposite feature to first detent 106. For example, if first detent 106 is a protrusion, then second detent 108 may be a recess or a hole, or vice versa. In the illustrated example, first detent 106 is a protrusion and second detent 108 is a recess or a hole. Referring to FIGS. 2 and 6, when the magazine 50 is introduced into the U-shaped channel 104, the first detent 106 is received in the first detent 58 and the second detent 60 is received in the second detent 108.

Figure 8:
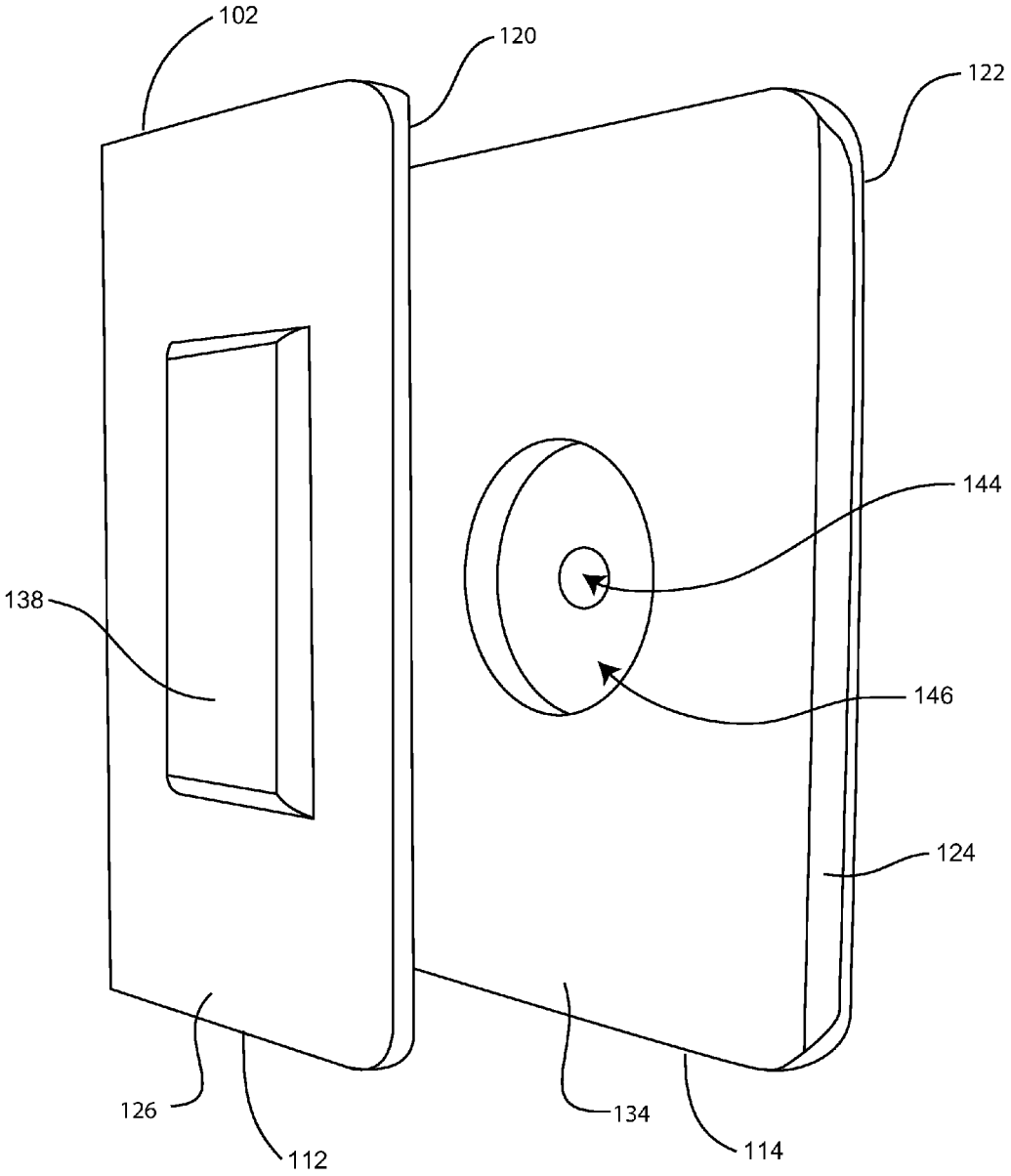
FIG. 8 is a left isometric view of the accessory holder of FIG. 1.

Referring to FIGS. 3B and 8, the accessory holder 102 may optionally include a first reinforcement 138 located on the exterior surface 126 of the first wall 112 opposite the first detent 106, and the second detent 108 if present in this location. First reinforcement 138 may be a protrusion extending from the exterior surface 126 to locally increase wall thickness in the vicinity of the first detent 106, and the second detent 108 if present. First reinforcement 138 may be circular, oval, elliptical, polygonal, irregular, or other shape; a rectangle is illustrated. First reinforcement 138 may provide sufficient wall thickness, with wall 112 itself, to support and surround first detent 106, and second detent 108 if present.

Referring to FIGS. 3A-3B, the fitting 110 is located on the exterior surface 128 of the second wall 114. The fitting 110 may be referred to as an accessory holder fitting or a holder fitting. The fitting 110 may be a circular or non-circular feature which may protrude above, or be recessed beneath, the nominal exterior surface 128. The fitting 110 provides a plurality of rotational positions or locations about a central axis 142 of the fitting (FIG. 3B). In the illustrated example, the fitting 110 is a protrusion which provides up to four different rotational positions about axis 142 as a result of a cruciform or four-lobed cross-sectional shape of the fitting 110. When the fitting 110 is coupled to a complementary second fitting having a socket with the same cross-sectional shape, slightly oversize for clearance, four rotational positions are provided at zero degrees, 90 degrees, 180 degrees, and 270 degrees. A similar effect may be achieved with other noncircular cross-sectional shapes, such as a square, a four-point star, or a quatrefoil. While four discrete rotational positions are shown in this example, any number of rotational positions may be provided by the fitting 110. One series of shapes for this purpose is the polygon of 3, 4, 5, 6 or more sides. Another series of shapes is the polylobe of 2, 3, 4, 5, 6 or more lobes. Another series of shapes is the star with 3, 4, 5, 6 or more points. The angular increment between discrete rotational positions may be calculated by dividing 360 degrees by the number of rotational positions: 3 rotational positions at 120 degrees apart, 4 rotational positions at 90 degrees apart, 5 rotational positions at 72 degrees apart, etc. In yet another example, the fitting 110 may be circular and may thus provide an infinite number of rotational positions about axis 142.

The fastener 2 extends through a hole 144 that is coaxial with axis 142 and extends through the second wall 114 and the fitting 110. The fastener 2 may be a threaded fastener such as a screw or bolt, or a captive panel screw or spring plunger, or another type of fastener. The illustrated fastener 2 is a screw with a head 4 and a threaded shaft 6. The head 4 includes a torque feature (not shown) for tightening and loosening the fastener 2. Some common examples of torque features include hex head, hex socket, slotted head, Phillips head, and hexalobular socket. The head 4 may be received in a pocket 146 which is recessed in the interior surface 134 of the second wall 114. The threaded shaft 6 of the fastener 2 may extend past the fitting 110 when the head 4 is fully seated in the pocket 146.

Referring to FIG. 3A, the accessory holder 102 may optionally include a second reinforcement 140 located on the exterior surface 128 of the second wall 114 around the fitting 110 and opposite the pocket 146, if present. Second reinforcement 140 may be a protrusion extending from the exterior surface 128 to locally increase wall thickness in the vicinity of the fitting 110, and pocket 146 if present. Second reinforcement 140 may be circular, oval, elliptical, polygonal, irregular, or other shape; a rectangle is illustrated. Second reinforcement 140 may provide sufficient wall thickness, with wall 114 itself, to support and surround fitting 110, and pocket 146 if present.

Referring to FIG. 3B, a clamp assembly 176 of the accessory mount 100 includes a body 178 and a movable jaw 180. The body 178 includes a first side 182 and an opposite second side 184. In use, the first side 182 faces the exterior surface 128 of the second wall 114 and the second side 184 faces the accessory rail 28.

A threaded hole 186 extends into the body 178 from the first side 182, and may extend through the entire body 178. The threaded hole 186 receives the threaded shaft 6 of the fastener 2 in complementary threaded engagement. A complementary second fitting 188, or clamp fitting, also extends into the body 178 from the first side 182, although less deeply than does the threaded hole 186. The complementary second fitting 188 is shaped and sized for complementary engagement with the fitting 110. Since the illustrated fitting 110 is a four-lobed protrusion, the illustrated complementary second fitting 188 is a four-lobed socket, although an opposite arrangement is also contemplated. In use, the illustrated fitting 110 is received in the complementary second fitting 188 with clearance, in any one of the four rotational positions provided, and the fastener 2 extends through hole 144 with head 4 in pocket 146 and threaded shaft 6 in threaded engagement with threaded hole 186.

The second side 184 of the body 178 includes a fixed jaw 190. The second side 184 carries the movable jaw 180 opposite to, and facing, the fixed jaw. The movable jaw 180 may be secured to the body 178 with a fastener 198. The fastener 198 may be spring biased to urge the movable jaw 180 toward the fixed jaw 190. The fastener 198 may also fix or lock the movable jaw 180 relative to the fixed jaw 190. Each jaw 180, 190 includes a tooth 192 which extends toward the opposite jaw, and an adjacent groove 194, or recess, which extends away from the opposite jaw. Thus the overall configuration of the fixed and movable jaws 180, 190 in their operative arrangement provides a T-shape, dovetail shape, or undercut cavity 196 on the second side 184 of the body 178 of the clamp assembly 176. The undercut cavity 196 receives the accessory rail 28 to couple the clamp assembly 176 to the accessory rail, while the fastener 198 locks the movable jaw 180 relative to the fixed jaw 190 to lock the clamp assembly 176 to the accessory rail.

The separate accessory holder 102 and clamp assembly 176 have an interconnection via the fitting 110 and the complementary second fitting 188 which provides multiple orientations of the accessory holder 102 relative to the clamp assembly 176. The multiple orientations go beyond simple reversibility (180 degree increment) to provide finer increments such as 120 degrees, 90 degrees, 72 degrees, 60 degrees, 51.43 degrees, 45 degrees, 40 degrees, 36 degrees, or other increments.

Figure 4A:
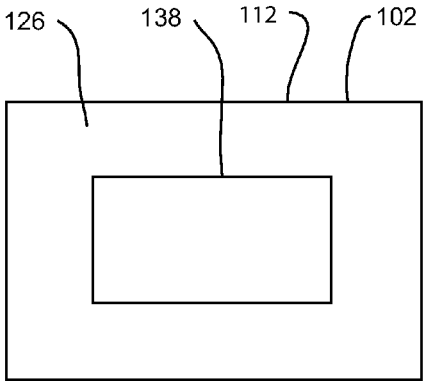
FIG. 4A is a left exterior view of a first wall of the accessory holder of FIG. 3A.
Figure 4B:
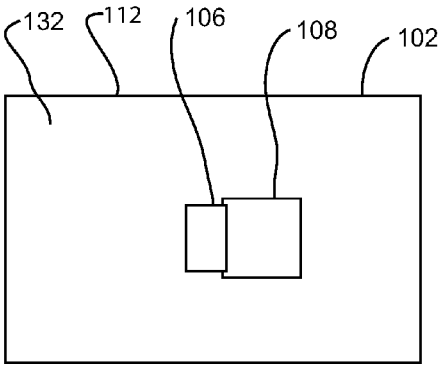
FIG. 4B is an interior view of the first wall of the accessory holder of FIG. 3A.
Figure 4C:
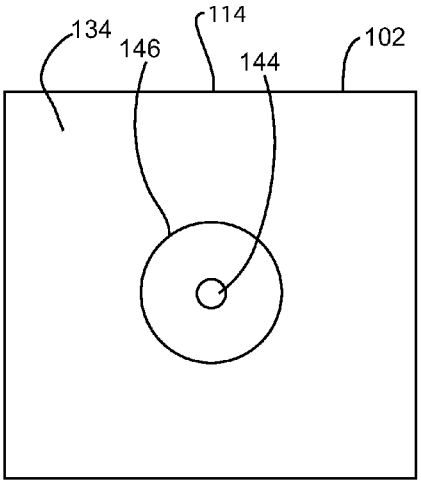
FIG. 4C is an interior view of a second wall of the accessory holder of FIG. 3A.
Figure 4D:
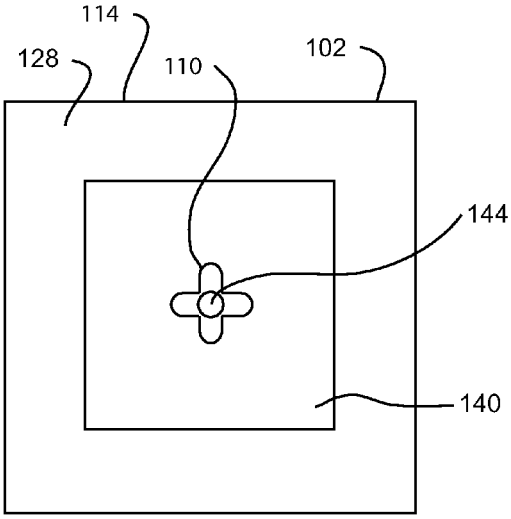
FIG. 4D is a right exterior view of the second wall of the accessory holder of FIG. 3A.

FIGS. 4A-4D show the exterior surfaces 126, 128 and interior surfaces 132, 134 of the first and second walls 112, 114. Referring to FIG. 4A, the exterior surface 126 and first reinforcement 138 are shown. The illustrated first reinforcement 138 is rectangular. Referring to FIG. 4B, the interior surface 132, first detent 106, and second detent 108 are shown. Referring to FIG. 4C, the interior surface 134, hole 144, and pocket 146 are shown. The illustrated pocket 146 is round. Referring to FIG. 4D, the exterior surface 128, fitting 110, hole 144, and second reinforcement 140 are shown.

Figure 5:
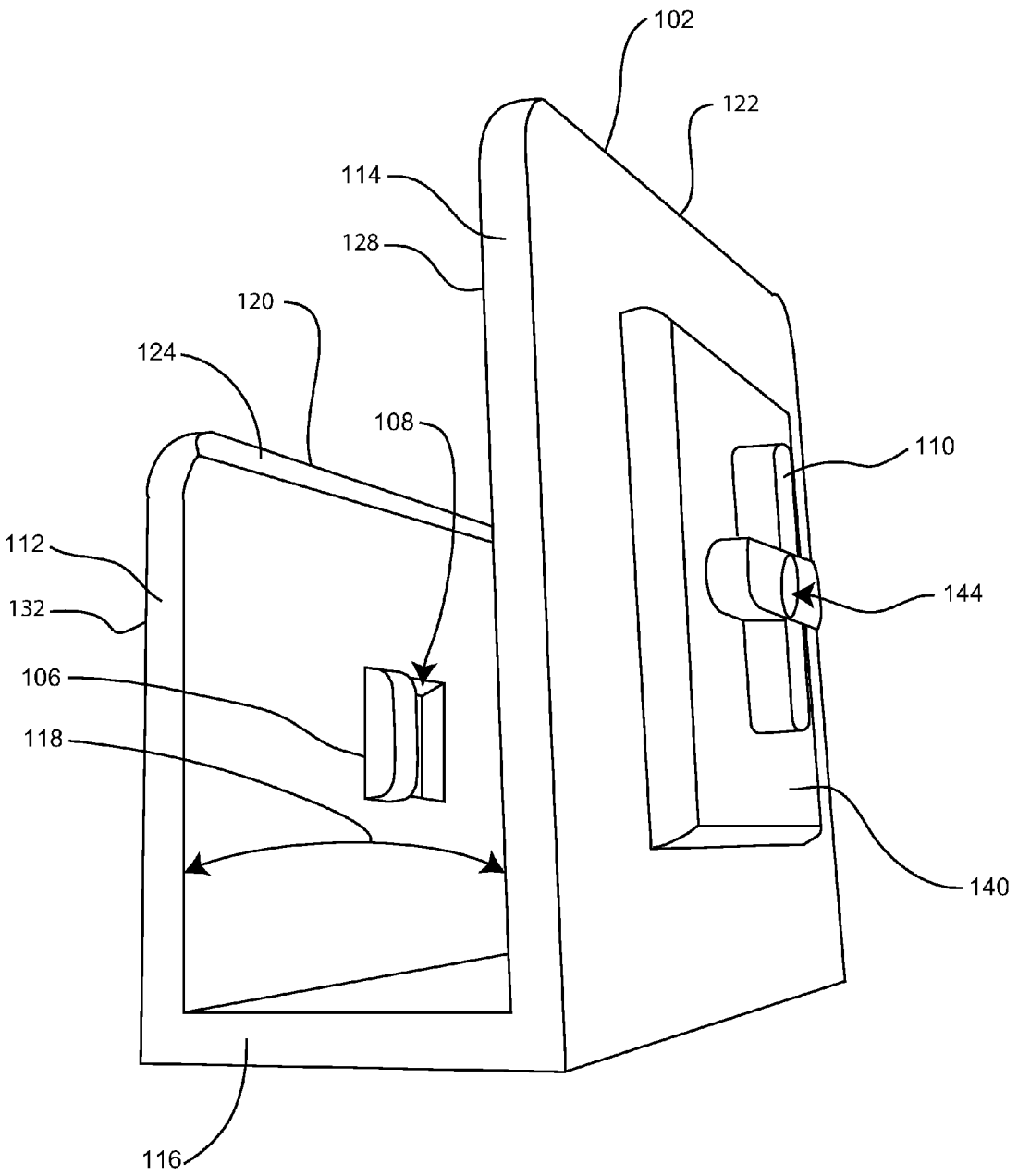
FIG. 5 is another right isometric view of the accessory holder of FIG. 1.
Figure 7:
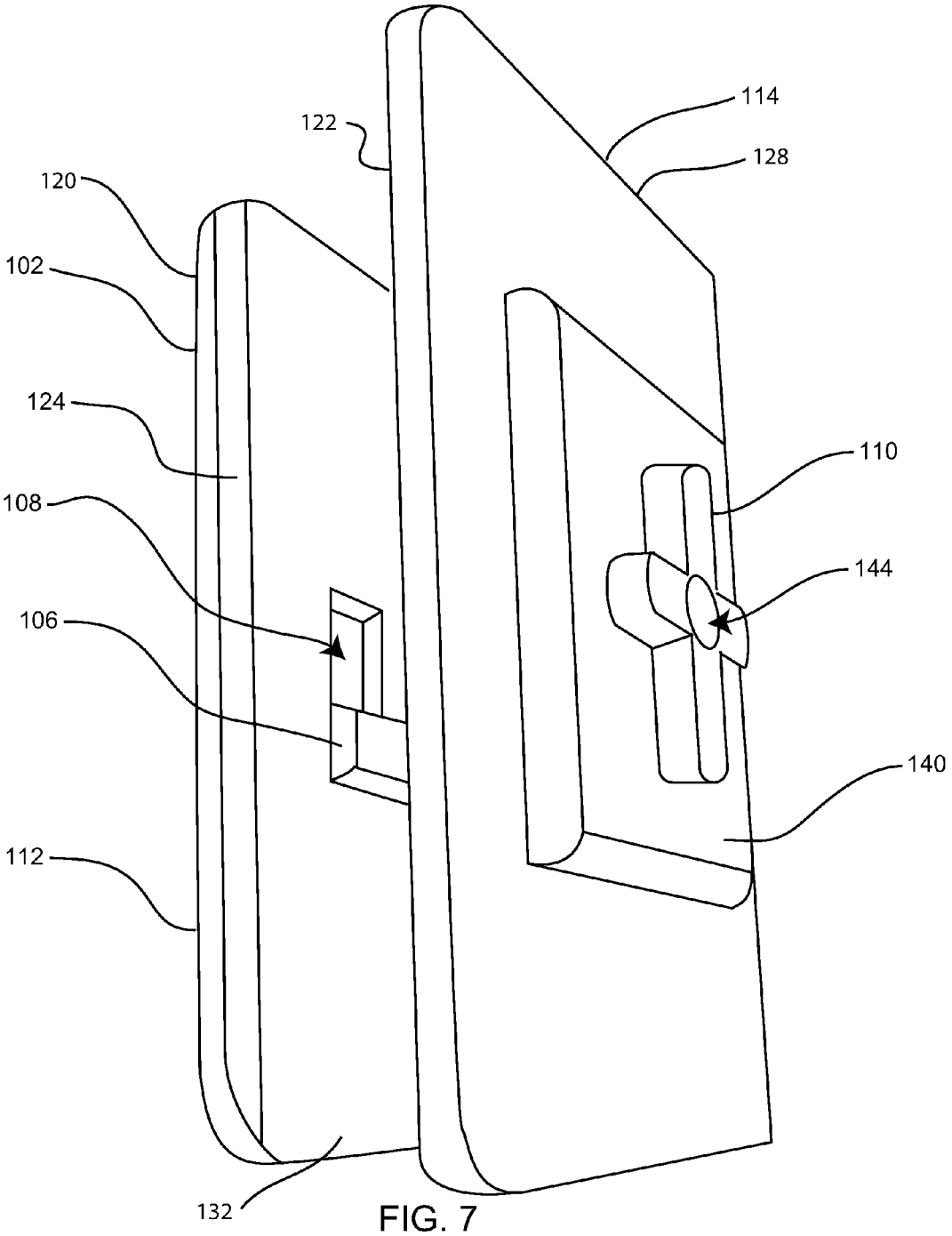
FIG. 7 is yet another right isometric view of the accessory holder of FIG. 1.

FIGS. 5-8 are additional isometric views of the accessory holder 102 from various directions. FIG. 5 is a right rear isometric view; FIG. 6 is a top right rear isometric view; FIG. 7 is a top right isometric view; and FIG. 8 is a top left isometric view.

Figure 9:
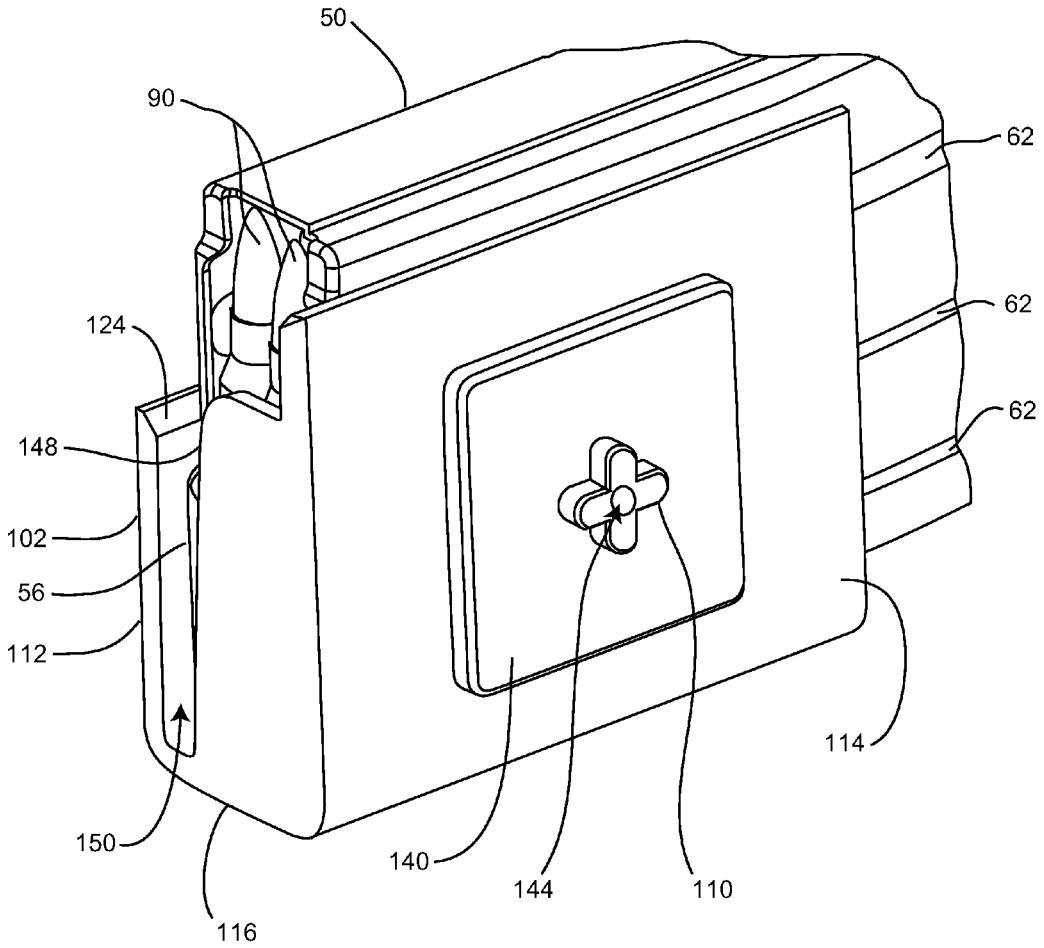
FIG. 9 is a right isometric view of the accessory holder of FIG. 1, with an optional fourth wall, coupled to a magazine.
Figure 10:
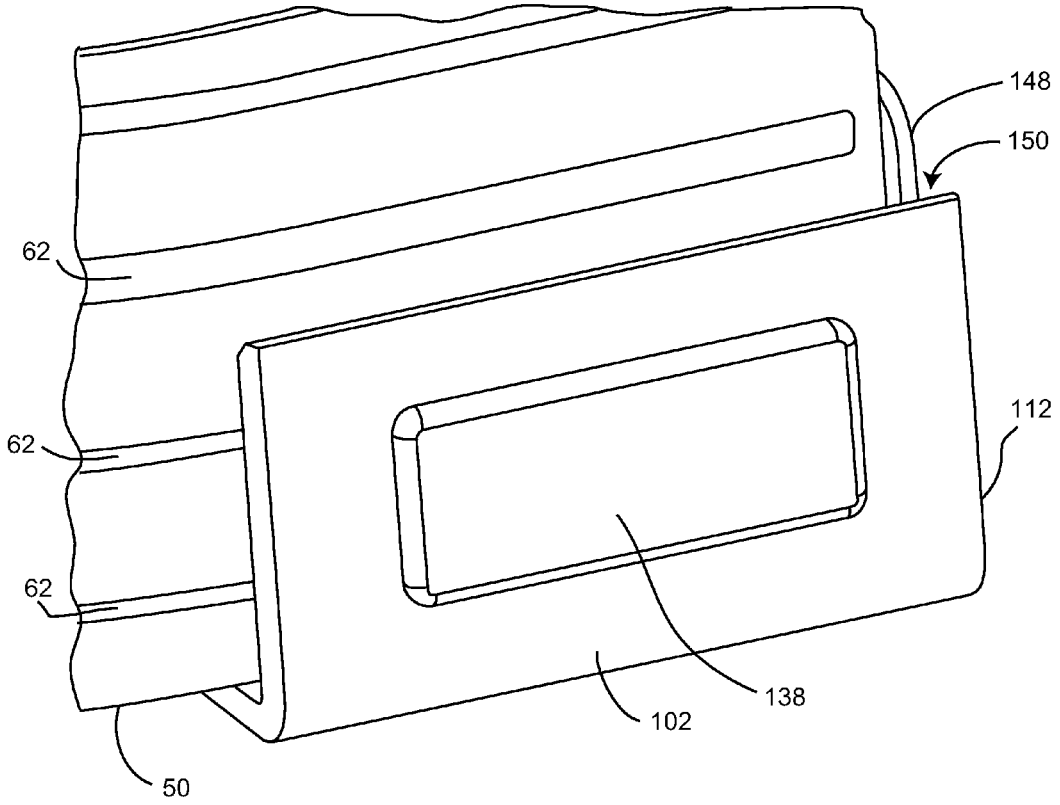
FIG. 10 is a left isometric view of the accessory holder and magazine of FIG. 9.

Referring to FIGS. 9-10, the accessory holder 102 is shown holding the magazine 50. Cartridges 90 are visible inside the magazine 50. In FIG. 9, an optional fourth wall 148 is shown. The fourth wall 148 at least partially closes off one of the open ends of the U-shaped channel 104. In the example shown, the fourth wall 148 closes off the open end of the U-shaped channel 104 adjacent to the feed lip(s) 56 of the magazine 50. Referring briefly to FIG. 1, the fourth wall 148 faces the magazine well 12 of the firearm 10 in use. The fourth wall 148 may be connected to the first wall, the second wall 114, or the third wall 116. FIG. 9 shows an example in which the fourth wall 148 is connected to the second wall 114 and the third wall 116, but is separated from the first wall 112 by a slot 150. The fourth wall 148 may help the user quickly and properly position the magazine in the accessory holder 102 for secure retention by the first detents 58, 106, and optionally the second detents 60, 108. The slot 150 may permit the first wall 112 to flex to bias the detent 106 to automatically retain and release the magazine 50.

Figure 11A:
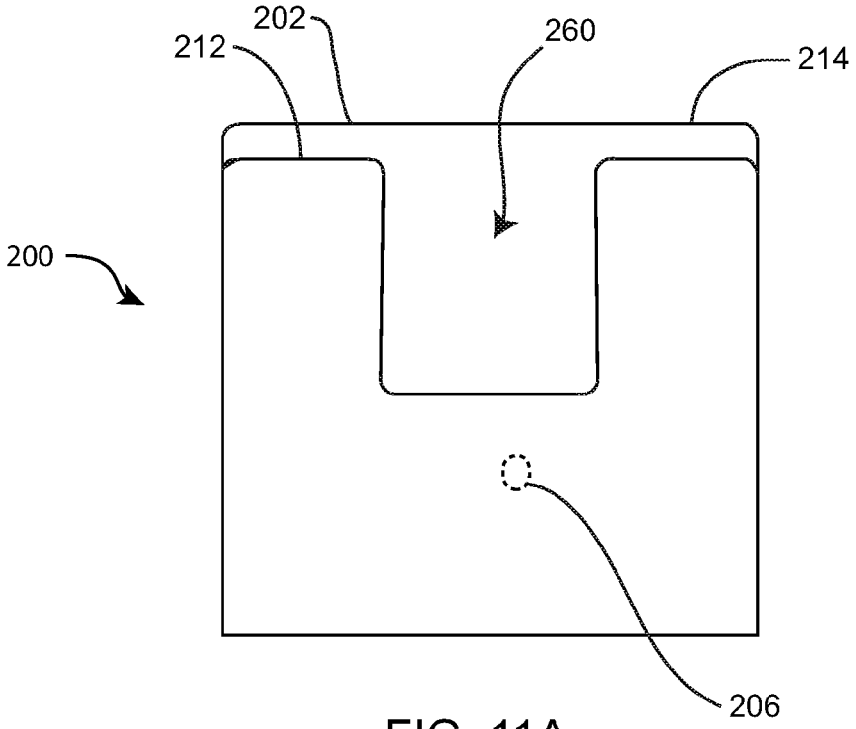
FIG. 11A is a left side view of another accessory holder.
Figure 11B:
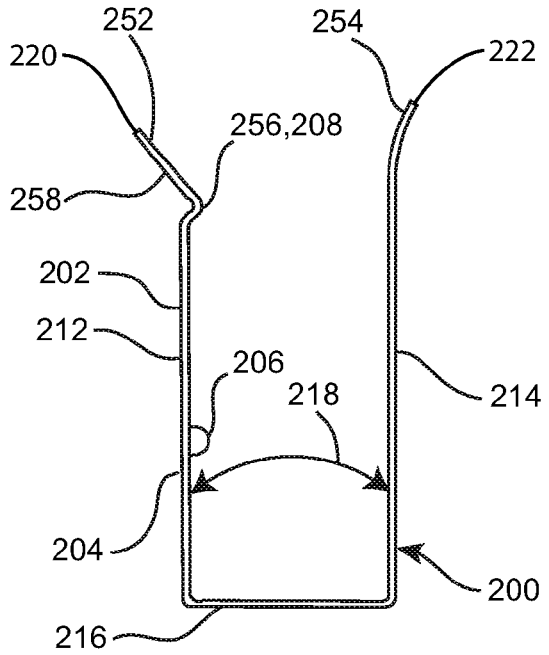
FIG. 11B is an end view of the accessory holder of FIG. 11A.

Referring to FIGS. 11A-11B, another accessory holder 202 may include a U-shaped channel 204, a first detent 206, a second detent 208, a first wall 212, a second wall 214, a third wall 216, and an angle 218 between the first wall 212 and the second wall 214, all of which may be as described for accessory mount 100. Accessory holder 202, fastener 2, and clamp assembly 176 may be assembled to form another accessory mount 200 (not shown in an assembled state). While accessory holder 202 is not shown with features comparable to the fitting 110, first reinforcement 138, second reinforcement 140, fitting axis 142, fitting hole 144, pocket 146, fourth wall 148, or slot 150, any or all of these features, as described elsewhere herein, may be included in accessory holder 202.

The U-shaped channel 204 includes a first wall 212 and a second wall 214 opposite to the first wall 212. The second wall 214 may be parallel to the first wall 212, or the second wall 214 may form an acute angle 218 of up to ±45 degrees with the first wall 212. Angle 218 is indicated in FIG. 11B. The magnitude of angle 218 may be zero degrees, or angle 218 may be non-zero so that the walls 212, 214 converge or diverge at their free ends 220, 222. The U-shaped channel 204 has an open side along the free ends 220, 222. The free ends 220, 222 of the first and second walls 212, 214 may include outwardly flaring portions 252, 254 which provide a generous lead-in to facilitate introducing the magazine into the U-shaped channel 204. Flaring portion 252 features a corrugated section 256 and an angled flat section 258. The corrugated section 256 may engage a longitudinal groove 62 in the hollow receptacle 52 of the magazine 50 (FIG. 2), such as is commonly found on metal magazines. The corrugated section 256 may be referred to as the second detent 208, and the longitudinal groove 62 may be referred to as a detent on the magazine 50. Flaring portion 254 is arcuate. A third wall 216 may connect the first wall 212 to the second wall 214 opposite the free ends 220, 222. In the illustrated example, the third wall 216 forms distinct corners with the first wall 212 and the second wall 214; in other examples, these corners may be sharp, gently radiused, or a full radius may exist between the first wall 212 and the second wall 214. The first wall 212 also includes a central notch 260 in its free end. While this example does not show a fitting or a fastener, both may be present in any of the forms disclosed herein. The central notch 260 may provide access to a fastener extending through the second wall 214 and fitting.

The first detent 206 is located on an interior surface of the first wall 212, and may protrude above, or be recessed beneath, the nominal interior surface; in some instances first detent 206 may be a hole or window. In the example, first detent 206 protrudes into the interior space of the U-shaped channel 204 to engage the first detent 58 of magazine 50.

The first detent 206 is biased to automatically retain the magazine 50 by engaging the first detent 58 when the magazine is introduced into the U-shaped channel 204. The magazine 50 may be retained without direct or indirect user actuation of the first detent 206 (for example, without pressing a button or lever) and may be retained without the user touching the accessory mount 200 at all, only touching the portion of the magazine 50 that protrudes past the accessory mount 200. Bias may be provided by the inherent resilience of the first wall 212 or the U-shaped channel 204, or by a spring element, such as a flat spring or a torsion spring. In an alternate example, the first detent 206 may be bounded on all but one side by a slit (not shown) which separates the first detent 206 from the rest of the first wall 212 so that the first detent 206 is carried on a cantilever tab; in this example, bias may be provided by the inherent resilience of the cantilever tab, or by a spring element that forms the cantilever tab and/or the first detent 206.

The first detent 206 also automatically releases the magazine 50 when the magazine is removed from the U-shaped channel 204. The magazine 50 may be released without direct or indirect user actuation of the first detent 206 (for example, without pressing a button or lever) and may be released without the user touching the accessory mount 200 at all, only touching the portion of the magazine 50 that protrudes past the accessory mount 200.

In addition to, or instead of, the corrugated section 256, the accessory holder 202 may include a detent (not shown) like second detent 108. The detent may protrude above, or be recessed beneath, the nominal interior surface; in some instances the detent may be a hole or window. The detent may be located adjacent to first detent 206, or elsewhere on the accessory holder 202. In some instances, the detent may be an opposite feature to first detent 206. For example, if first detent 206 is a protrusion, then the detent may be a recess or a hole, or vice versa. When the magazine 50 is introduced into the U-shaped channel 204, the first detent 206 is received in the first detent 58 and the second detent 60 is received in the detent.

Because of the lack of a distinct fitting, this example provides an infinite number of rotational orientations of the accessory holder 202 relative to the clamp assembly 176 about an axis comparable to axis 142.

Figure 12A:
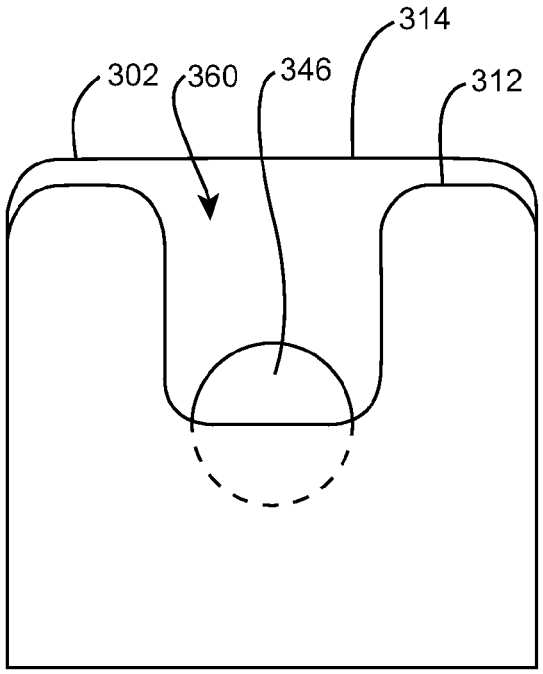
FIG. 12A is a left side view of yet another accessory holder.
Figure 12B:
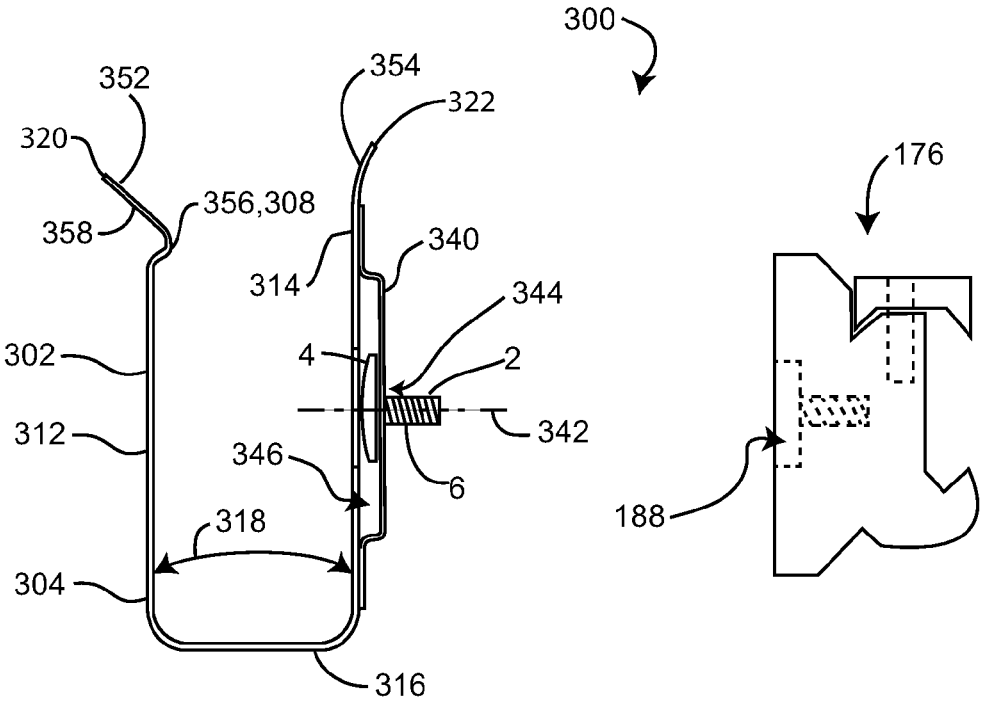
FIG. 12B is an exploded end view of another accessory mount including the accessory holder of FIG. 12A and the clamp assembly of FIG. 3B.

Referring to FIGS. 12A-B, yet another accessory mount 300 includes an accessory holder 302 and clamp assembly 176. Accessory holder 302 may include a U-shaped channel 304, a second detent 308, a first wall 312, a second wall 314, a third wall 316, an angle 318 between the first wall 312 and the second wall 314, an axis 342, a hole 344, a pocket 346, a second reinforcement 340 opposite the pocket 346, and a fastener 2, all of which may be as described for accessory mount 100. While accessory holder 302 is not shown with features comparable to first detent 106, fitting 110, first reinforcement 138, fourth wall 148, or slot 150, any or all of these features, as described elsewhere herein, may be included in accessory holder 302.

The U-shaped channel 304 includes a first wall 312 and a second wall 314 opposite to the first wall 312. The second wall 314 may be parallel to the first wall 312, or the second wall 314 may form an acute angle 318 of up to ±45 degrees with the first wall 312. Angle 318 is indicated in FIG. 12B. The magnitude of angle 318 may be zero degrees, or angle 318 may be non-zero so that the walls 312, 314 converge or diverge at their free ends 320, 322. The U-shaped channel 304 has an open side along the free ends 320, 322. The free ends 320, 322 of the first and second walls 312, 314 may include outwardly flaring portions 352, 354 which provide a generous lead-in to facilitate introducing the magazine into the U-shaped channel 304. Flaring portion 352 features a corrugated section 356 and an angled flat section 358. The corrugated section 356 may engage the longitudinal groove 62 of the magazine 50, as is commonly found on metal magazines. The corrugated section 356 may be referred to as the second detent 308 on the accessory holder 302. Flaring portion 354 is arcuate. A third wall 316 may connect the first wall 312 to the second wall 314 opposite the free ends 320, 322. In the illustrated example, the third wall 316 forms rounded corners with the first wall 312 and the second wall 314; in other examples, these corners may be square, or there may be a full radius between the first wall 312 and the second wall 314. The first wall 312 also includes a central notch 360 in its free end. While this example does not show a fitting, one may be present in any of the forms disclosed herein. The central notch 260 may provide access to the fastener 2 extending through the second wall 214 and second reinforcement 340.

In addition to, or instead of, the corrugated section 356, the accessory holder 302 may include a detent (not shown) like the first detent 106, and/or a detent (not shown) like the second detent 108.

The fastener 2 extends through a hole 344 that is coaxial with axis 342 and extends through the second wall 314. The head 4 may be received in a pocket 346 which is recessed in an interior surface of the second wall 314. The threaded shaft 6 of the fastener 2 may extend past the second wall 314 when the head 4 is fully seated in the pocket 346.

Because of the lack of a distinct fitting, this example provides an infinite number of rotational orientations of the accessory holder 302 relative to the clamp assembly 176 about the axis 342.

Referring to FIG. 12B, the accessory holder 302 may optionally include a second reinforcement 340 located on an exterior surface of the second wall 314 opposite the pocket 346. Second reinforcement 340 may be a protrusion extending from the exterior surface of the second wall 314 to locally increase wall thickness in the vicinity of the pocket 346. Second reinforcement 340 may be circular, oval, elliptical, polygonal, irregular, or other shape. Second reinforcement 340 may provide sufficient wall thickness, with wall 314 itself, to support and surround pocket 346.

Figure 13:
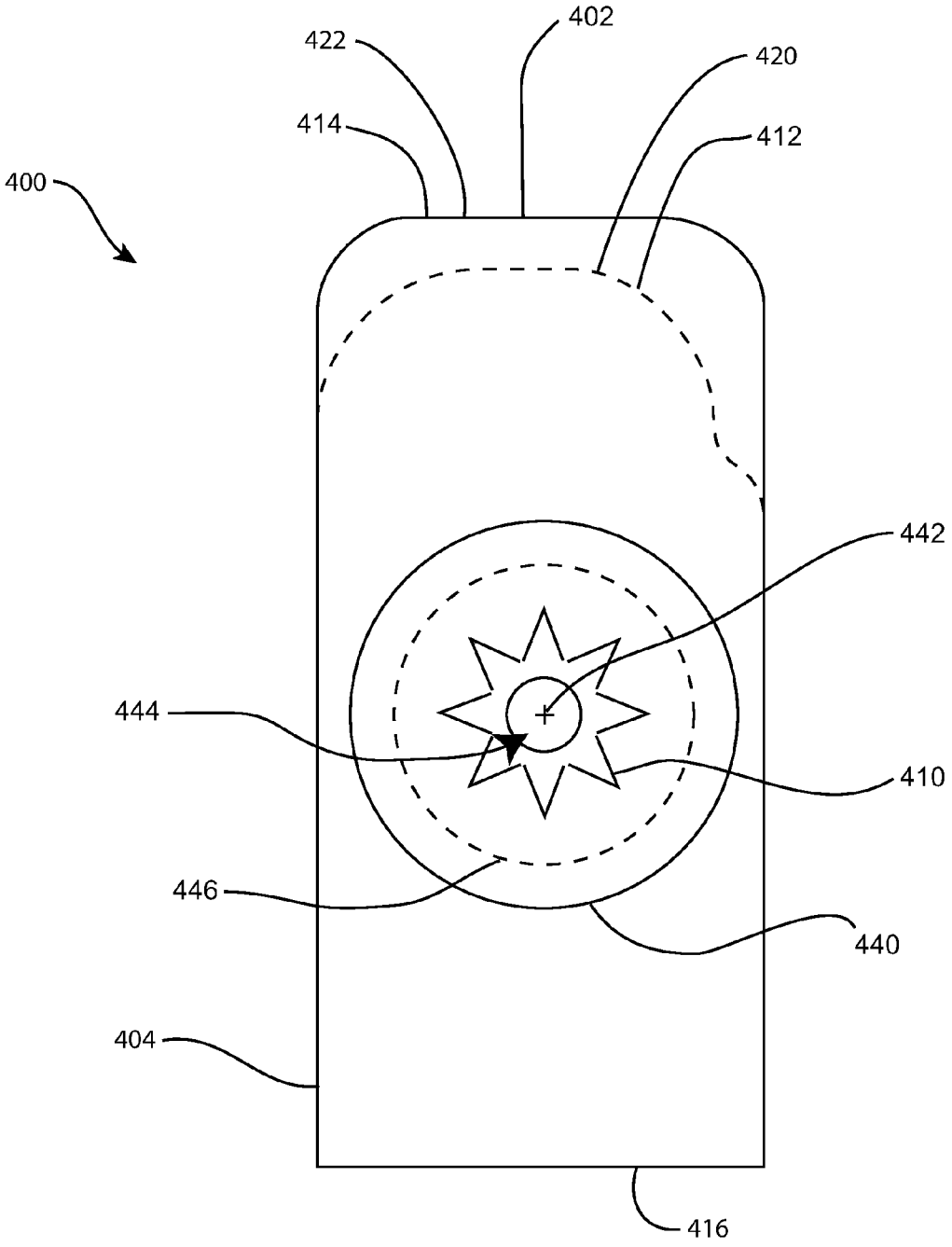
FIG. 13 is a right side view of yet another accessory holder.

Referring to FIG. 13, yet another accessory holder 402 is shown. Accessory holder 402, fastener 2, and clamp assembly 176 may be assembled to form yet another accessory mount 400 (not shown in an assembled state). Accessory holder 402 is shown in a right side view. In this view, a U-shaped channel 404, fitting 410, first wall 412 (in dashed line), second wall 414, third wall 416, second reinforcement 440, fitting axis 442, hole 444, and pocket 446 (in dashed line) are shown, all of which may be as described for accessory holder 102. While this view does not show features comparable to the first detent 106, second detent 108, angle 118 between the first and second walls, first reinforcement 138, fourth wall 148, slot 150, flaring portions 252, 254, corrugated section 256, angled flat section 258, or notch 260, any or all of these features, as described elsewhere herein, may be included in accessory holder 402.

The U-shaped channel 404 includes a first wall 412 and a second wall 414 opposite to the first wall 412. The second wall 414 may be parallel to the first wall 412, or the second wall 414 may form an acute angle of up to ±45 degrees with the first wall 412 so that the walls 412, 414 converge or diverge at their free ends 420, 422. The U-shaped channel 404 has an open side along the free ends 420, 422. The free ends 420, 422 of the first and second walls 412, 414 may include chamfers or another kind of lead-in feature or edge break feature. A third wall 416 may connect the first wall 412 to the second wall 414 opposite the free ends 420, 422.

The end view (not shown) of accessory holder 402 resembles that of accessory holder 302 (FIG. 12B), although accessory holder 402 includes a fitting 410.

The fitting 410 is located on an exterior surface of the second wall 414. The fitting 410 may be referred to as an accessory holder fitting or a holder fitting. The fitting 410 may protrude above, or be recessed beneath, the nominal exterior surface. The fitting 410 provides a plurality of discrete rotational positions or locations about a central axis 442 of the fitting, seen on end as a point in this view. The fitting 410 illustrates a shape that provides eight different rotational positions about axis 442. The eight-point star shape shown may be replaced with an octagonal shape or an octolobular shape to achieve similar performance. The eight-point star shape shown may be replaced with a star shape with 3, 4, 5, 6 or more points. When the fitting 410 is coupled to a complementary second fitting having a feature with the same eight-point star cross-sectional shape, slightly offset for clearance, eight rotational positions are provided at zero degrees, 45 degrees, 90 degrees, 135 degrees, 180 degrees, 225 degrees, 270 degrees, and 315 degrees.

The fastener 2 may extend through a hole 444 that is coaxial with axis 442 and extends through the second wall 414 and the fitting 410. The head 4 of the fastener 2 may be received in a pocket 446 which is recessed in the interior surface 434 of the second wall 414. The shaft 6 of the fastener 2 may extend past the fitting 410 when the head of the fastener 2 is fully seated in the pocket 446.

The accessory holder 402 may optionally include a second reinforcement 440 located on the exterior surface of the second wall 414 around the fitting 410 and opposite the pocket 446, if present. Second reinforcement 440 may be a protrusion extending from the exterior surface to locally increase wall thickness in the vicinity of the fitting 410, and pocket 446 if present. Second reinforcement 440 may be circular, oval, elliptical, polygonal, irregular, or other shape. The illustrated example is circular. Second reinforcement 440 may provide sufficient wall thickness, with wall 414 itself, to support and surround fitting 410, and pocket 446 if present.

Figure 14A:
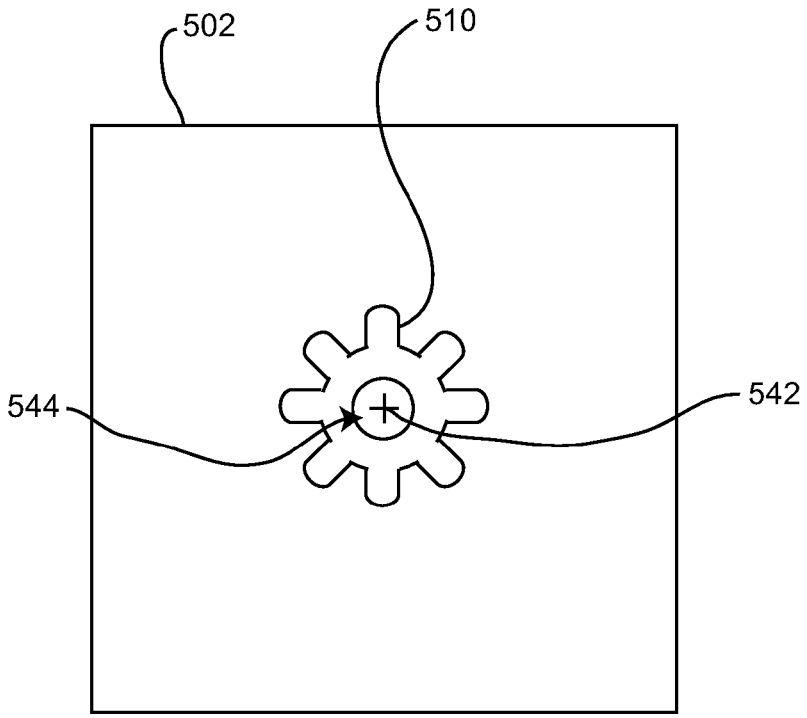
FIG. 14A is a right side view of yet another accessory holder.
Figure 14B:
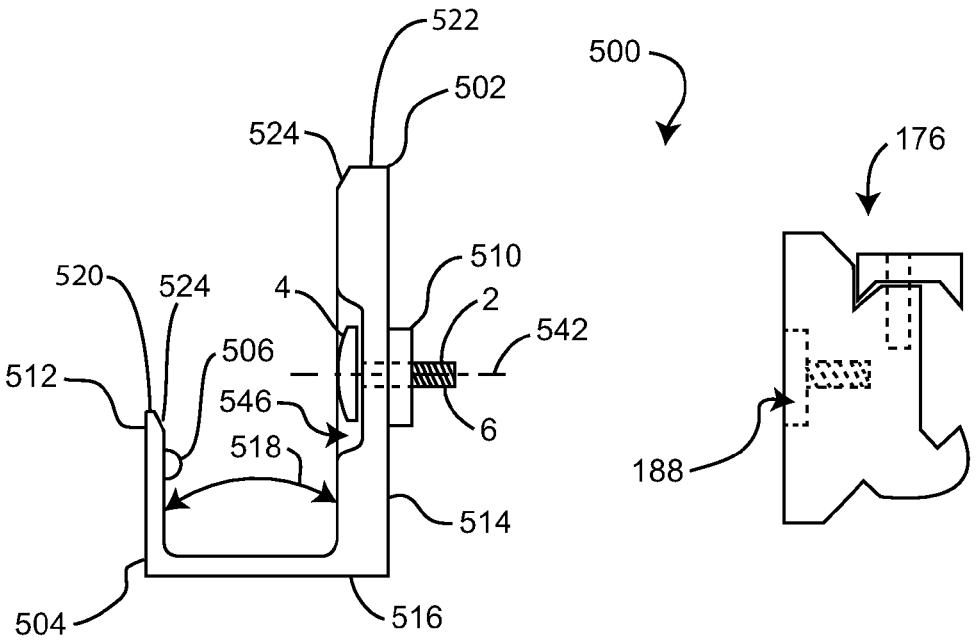
FIG. 14B is an exploded end view of yet another accessory mount including the accessory holder of FIG. 14A and the clamp assembly of FIG. 3B.

Referring to FIGS. 14A and 14B, yet another accessory mount 500 includes an accessory holder 502, a fastener 2, and clamp assembly 176. Accessory holder 502 may include a U-shaped channel 504, a first detent 506, a fitting 510, a first wall 512, a second wall 514, a third wall 516, an angle 518 between the first wall 512 and the second wall 514, chamfers 524, a fitting axis 542, a hole 544, and a pocket 546, all of which may be as described for accessory mount 100. While accessory holder 502 is not shown with features comparable to second detent 108, first reinforcement 138, second reinforcement 140, fourth wall 148, slot 150, flaring portions 252, 254, corrugated section 256, angled flat section 258, or notch 260, any or all of these features, as described elsewhere herein, may be included in accessory holder 502.

The U-shaped channel 504 includes a first wall 512 and a second wall 514 opposite to the first wall 512. The second wall 514 may be parallel to the first wall 512, or the second wall 514 may form an acute angle 518 of up to ±45 degrees with the first wall 512. Angle 518 is indicated in FIG. 14B. The magnitude of angle 518 may be zero degrees, or angle 518 may be non-zero so that the walls 512, 514 converge or diverge at their free ends 520, 522. The U-shaped channel 504 has an open side along the free ends 520, 522. The free ends 520, 522 of the first and second walls 512, 514 may include chamfers 524 or another kind of lead-in feature or edge break feature. A third wall 516 may connect the first wall 512 to the second wall 514 opposite the free ends 520, 522. In the illustrated example, the third wall 516 forms distinct square corners with the first wall 512 and the second wall 514; in other examples, these corners may be rounded or there may be a full radius between the first wall 512 and the second wall 514.

The first detent 506 is located on an interior surface of the first wall 512, and may protrude above, or be recessed beneath, the nominal interior surface; in some instances first detent 506 may be a hole or window. In the example, first detent 506 protrudes into the interior space of the U-shaped channel 504 to engage the first detent 58 of magazine 50.

The first detent 506 is biased to automatically retain the magazine 50 by engaging the first detent 58 when the magazine is introduced into the U-shaped channel 504. The magazine 50 may be retained without direct or indirect user actuation of the first detent 506 (for example, without pressing a button or lever) and may be retained without the user touching the accessory mount 500 at all, only touching the portion of the magazine 50 that protrudes past the accessory mount 500. Bias may be provided by the inherent resilience of the first wall 512, or by a spring element, such as a flat spring or a torsion spring. In an alternate example, the first detent 506 may be bounded on all but one side by a slit (not shown) which separates the first detent 506 from the rest of the first wall 512 so that the first detent 506 is carried on a cantilever tab; in this example, bias may be provided by the inherent resilience of the cantilever tab, or by a spring element that forms the cantilever tab and/or the first detent 506.

The first detent 506 also automatically releases the magazine 50 when the magazine is removed from the U-shaped channel 504. The magazine 50 may be released without direct or indirect user actuation of the first detent 506 (for example, without pressing a button or lever) and may be released without the user touching the accessory mount 500 at all, only touching the portion of the magazine 50 that protrudes past the accessory mount 500.

The accessory holder 502 may include a detent (not shown) like second detent 108. The detent may protrude above, or be recessed beneath, the nominal interior surface; in some instances the detent may be a hole or window. The detent may be located adjacent to first detent 506, or elsewhere on the accessory holder 502. In some instances, the detent may be an opposite feature to first detent 506. For example, if first detent 506 is a protrusion, then the detent may be a recess or a hole, or vice versa. When the magazine 50 is introduced into the U-shaped channel 504, the first detent 506 is received in the first detent 58 and the second detent 60 is received in the detent.

The fitting 510 is located on an exterior surface of the second wall 514. The fitting 510 may be referred to as an accessory holder fitting or a holder fitting. The fitting 510 may protrude above, or be recessed beneath, the nominal exterior surface 528. The fitting 510 provides a plurality of discrete rotational positions or locations about a central axis 542 of the fitting (FIGS. 14A and 14B). The fitting 510 illustrates another shape that provides eight different rotational positions about axis 542. The illustrated octolobular shape may be replaced with an octagonal shape or an eight-point star shape to achieve similar function. The octolobular shape may be replaced with a polylobe of 2, 3, 4, 5, 6 or more lobes. When the fitting 510 is coupled to a complementary second fitting having a feature with the same octolobular cross-sectional shape, slightly offset for clearance, eight rotational positions are provided at zero degrees, 45 degrees, 90 degrees, 135 degrees, 180 degrees, 225 degrees, 270 degrees, and 315 degrees.

The fastener 2 extends through a hole 544 that is coaxial with axis 542, which extends through the second wall 514 and the fitting 510. The head 4 may be received in a pocket 546 which is recessed in the interior surface 534 of the second wall 514. The threaded shaft 6 of the fastener 2 may extend past the fitting 510 when the head 4 is fully seated in the pocket 546.

Referring to FIG. 14B, the thickness of the second wall 514 is greater than the thickness of the first wall 512. Thus, the entire second wall 514 may be referred to as a second reinforcement for the pocket 546, fitting 510, and hole 544.

Referring to FIG. 14B, clamp assembly 176 may include a complementary octolobular second fitting 188 for engagement with fitting 510, and may likewise include various complementary second fittings 188 for engagement with any of the fittings described herein.

Figure 15A:
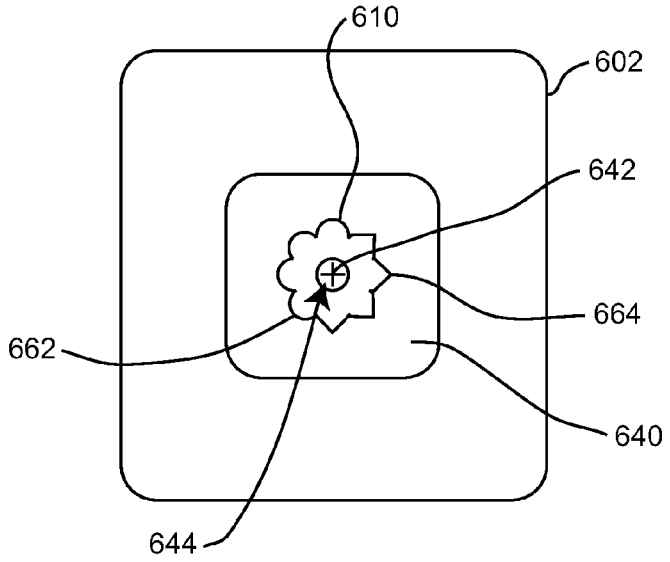
FIG. 15A is a right side view of yet another accessory holder.
Figure 15B:
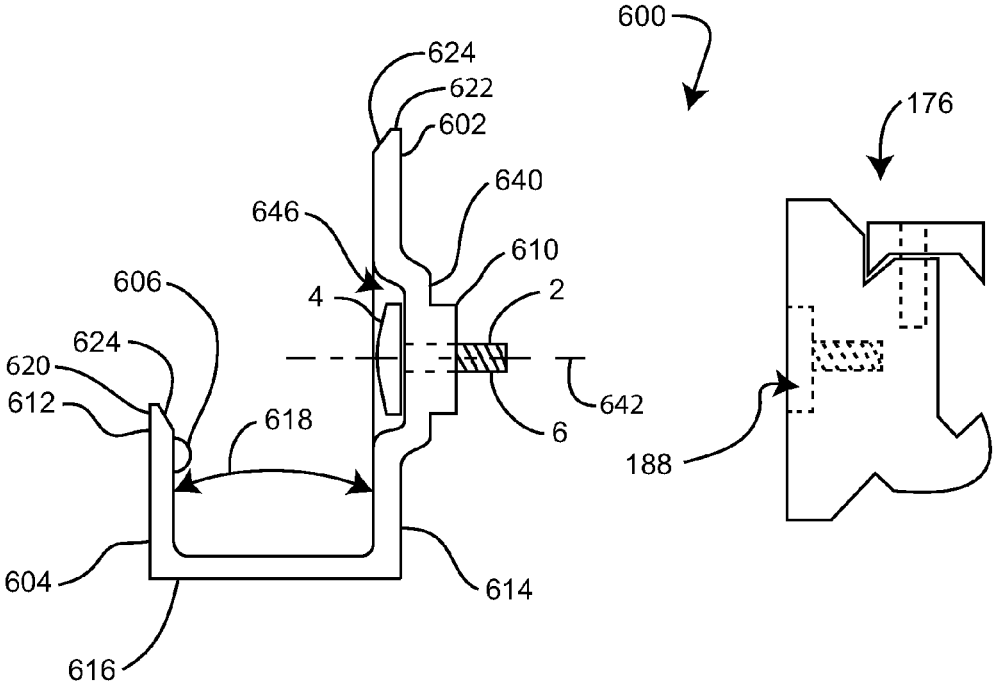
FIG. 15B is an exploded end view of yet another accessory mount including the accessory holder of FIG. 15A and the clamp assembly of FIG. 3B.

Referring to FIGS. 15A-B, yet another accessory mount 600 includes an accessory holder 602, a fastener 2, and a clamp assembly 176. The accessory holder 602 may include a U-shaped channel 604, a first detent 606, a fitting 610, a first wall 612, a second wall 614, a third wall 616, an angle 618 between the first wall 612 and the second wall 614, chamfers 624, a second reinforcement 640, a fitting axis 642, a hole 644, and a pocket 646, all of which may be as described for accessory mount 100. While accessory holder 602 is not shown with features comparable to second detent 108, first reinforcement 138, fourth wall 148, slot 150, flaring portions 252, 254, corrugated section 256, angled flat section 258, or notch 260, any or all of these features, as described elsewhere herein, may be included in accessory holder 602.

The U-shaped channel 604 includes a first wall 612 and a second wall 614 opposite to the first wall 612. The second wall 614 may be parallel to the first wall 612, or the second wall 614 may form an acute angle 618 of up to ±45 degrees with the first wall 612 so that the walls 612, 614 converge or diverge at their free ends 620, 622. The U-shaped channel 604 has an open side along the free ends 620, 622. The free ends 620, 622 of the first and second walls 612, 614 may include chamfers 624 or another kind of lead-in feature or edge break feature. A third wall 616 may connect the first wall 612 to the second wall 614 opposite the free ends 620, 622. In the illustrated example, the third wall 616 forms distinct square corners with the first wall 612 and the second wall 614; in other examples, these corners may be rounded or a full radius may be present between the first wall 612 and the second wall 614.

The first detent 606 is located on an interior surface of the first wall 612, and may protrude above, or be recessed beneath, the nominal interior surface; in some instances first detent 606 may be a hole or window. In the example, first detent 606 protrudes into the interior space of the U-shaped channel 604 to engage the first detent 58 of magazine 50.

The first detent 606 is biased to automatically retain the magazine 50 by engaging the first detent 58 when the magazine is introduced into the U-shaped channel 604. The magazine 50 may be retained without direct or indirect user actuation of the first detent 606 (for example, without pressing a button or lever) and may be retained without the user touching the accessory mount 600 at all, only touching the portion of the magazine 50 that protrudes past the accessory mount 600. Bias may be provided by the inherent resilience of the first wall 612, or by a spring element, such as a flat spring or a torsion spring. In an alternate example, the first detent 606 may be bounded on all but one side by a slit (not shown) which separates the first detent 606 from the rest of the first wall 612 so that the first detent 606 is carried on a cantilever tab; in this example, bias may be provided by the inherent resilience of the cantilever tab, or by a spring element that forms the cantilever tab and/or the first detent 606.

The first detent 606 also automatically releases the magazine 50 when the magazine is removed from the U-shaped channel 604. The magazine 50 may be released without direct or indirect user actuation of the first detent 606 (for example, without pressing a button or lever) and may be released without the user touching the accessory mount 600 at all, only touching the portion of the magazine 50 that protrudes past the accessory mount 600.

The fitting 610 is located on the exterior surface 628 of the second wall 614. The fitting 610 may be referred to as an accessory holder fitting or a holder fitting. The fitting 610 may protrude above, or be recessed beneath, the nominal exterior surface 628. The fitting 610 provides a plurality of discrete rotational positions or locations about a central axis 642 of the fitting (FIGS. 15A and 15B). The fitting 610 illustrates another shape that provides four different rotational positions about axis 642. The illustrated shape includes a set of four lobes 662 and an opposite set of four points 664 arranged so that each lobe 662 has a corresponding point 664 positioned opposite the lobe. This shape provides four rotational positions, namely zero degrees, 45 degrees, 90 degrees, and 135 degrees. The four rotational positions are at consecutive 45 degree intervals. When fitting 610 is a protrusion, one example of a complementary second fitting has a socket with a first portion shaped to fit a lobe 662, an opposite second portion shaped to fit the point 664 opposite the lobe, and two opposing relief portions extending between the first and second portions. The relief portions may be arcuate with a radius larger than that of the lobes 662 and points 664. When fitting 610 is a socket, a complementary second fitting may have a bar with one end shaped to fit a lobe and an opposite second end shaped to fit a point. The fitting 610 may be modified to provide any number of consecutive rotational positions.

The fastener 2 extends through a hole 644 that is coaxial with axis 642, which extends through the second wall 614 and the fitting 610. The head 6 of the fastener 2 may be received in a pocket 646 which is recessed in the interior surface 634 of the second wall 614. The threaded shaft 6 of the fastener 2 may extend past the fitting 610 when the head 4 is fully seated in the pocket 646.

The accessory holder 602 may optionally include a second reinforcement 640 located on the exterior surface 628 of the second wall 614 around the fitting 610 and opposite the pocket 646, if present. Second reinforcement 640 may be a protrusion extending from the exterior surface 628 to locally increase wall thickness in the vicinity of the fitting 610, and pocket 646 if present. Second reinforcement 640 may be circular, oval, elliptical, polygonal, irregular, or other shape. The illustrated example is rectangular. Second reinforcement 640 may provide sufficient wall thickness, with wall 614 itself, to support and surround fitting 610, and pocket 646 if present.

Referring to FIGS. 16A-18, yet another accessory mount 700 includes an accessory holder 702 and another clamp assembly 776. The accessory holder 702 includes a U-shaped channel 704, a first detent 706, a second detent 708, a fitting 710, a first wall 712, a second wall 714, a third wall 716, an angle 718 between the first wall 712 and the second wall 714, chamfers 724, a fitting axis 742, a fourth wall 748, and a slot 750, all of which may be as described for accessory mount 100. While the accessory holder 702 is not shown with features comparable to first reinforcement 138, second reinforcement 140, fitting hole 144, pocket 146, flaring portions 252, 254, corrugated section 256, angled flat section 258, or notch 260, any or all of these features, as described elsewhere herein, may be included in accessory holder 702.

Figure 16A:
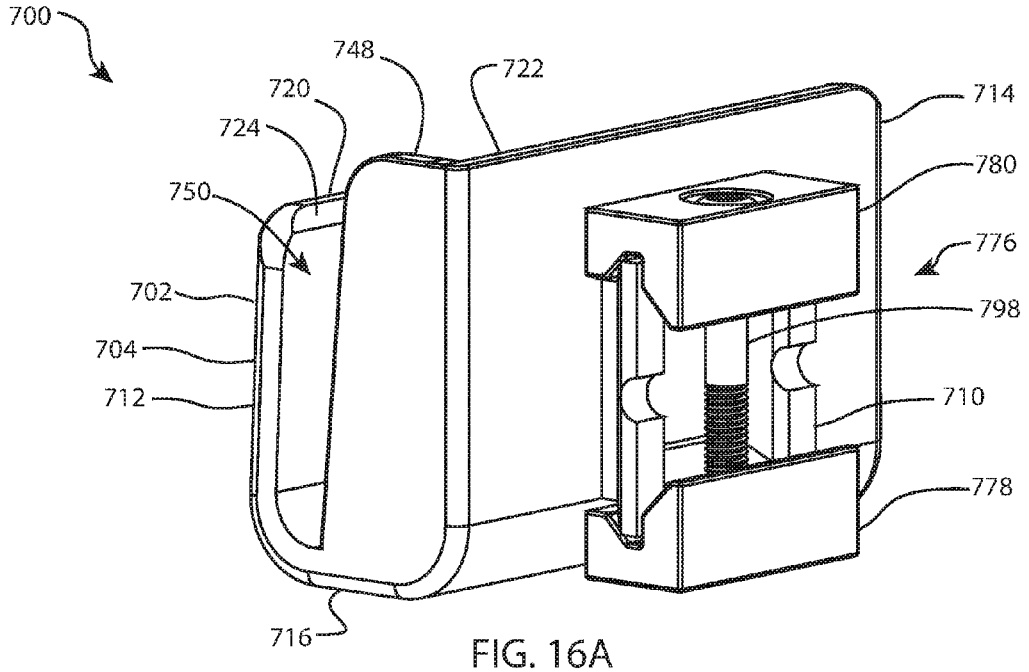
FIG. 16A is a right isometric view of yet another accessory mount.
Figure 16B:
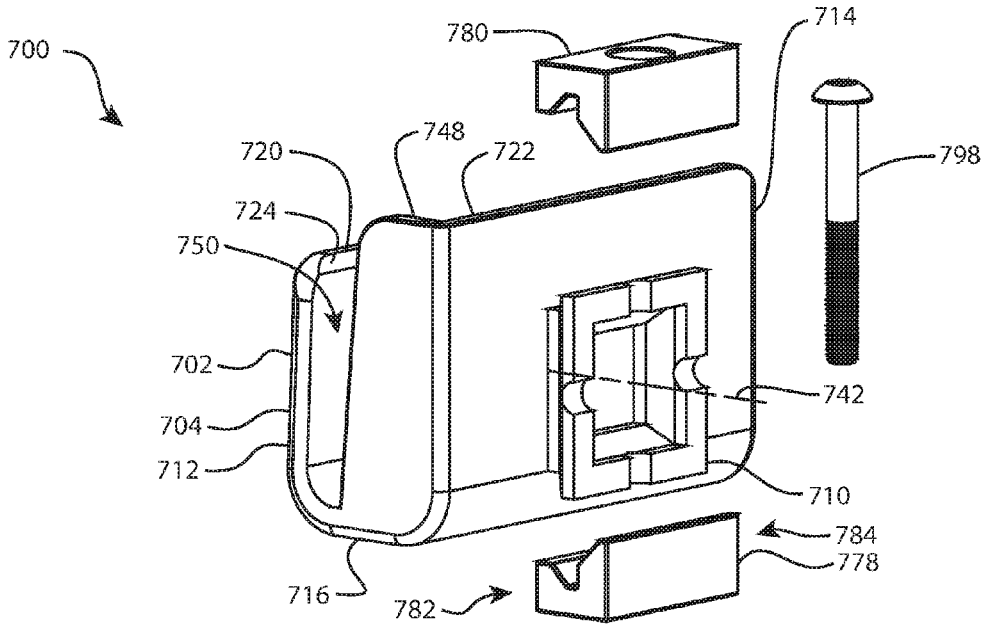
FIG. 16B is an exploded right isometric view of the accessory mount of FIG. 16A.
Figure 16C:
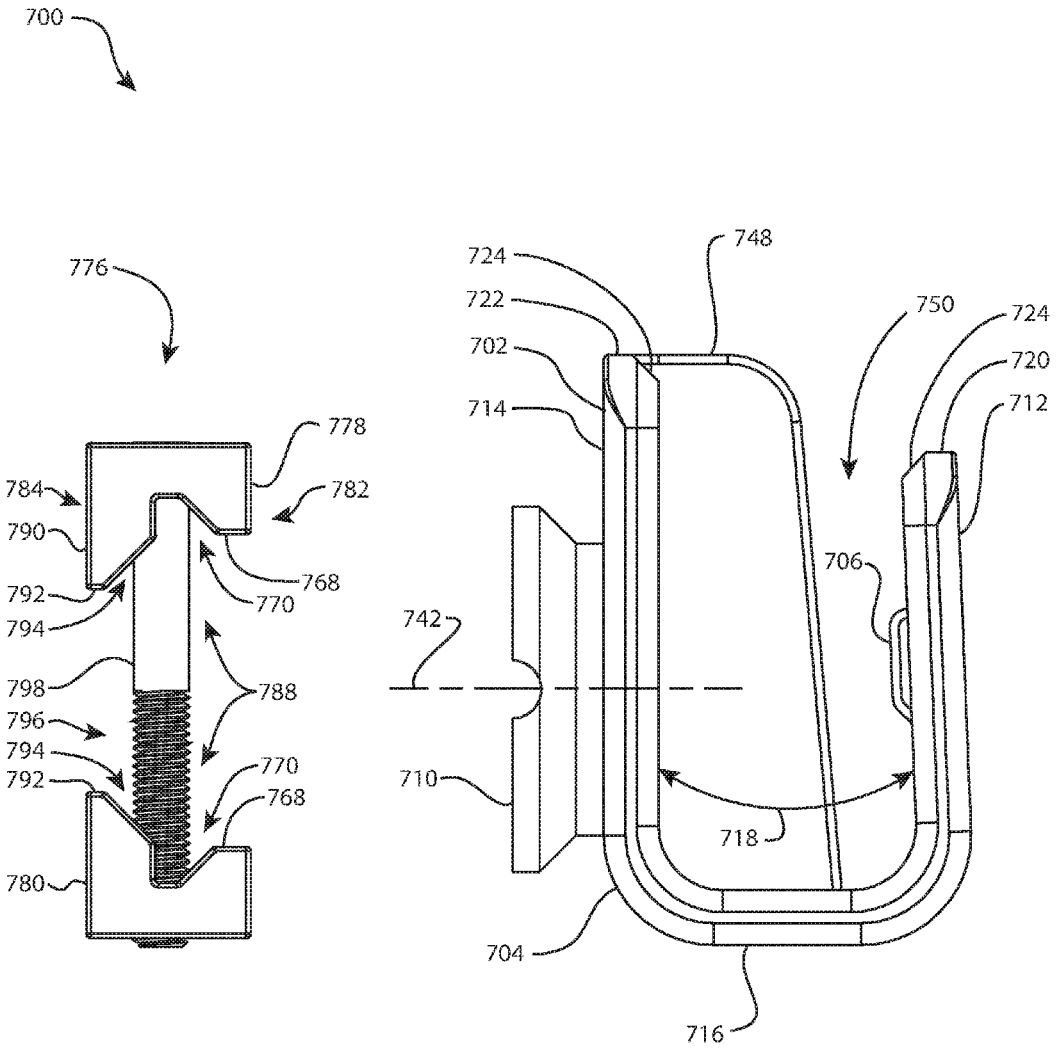
FIG. 16C is an exploded end view of the accessory mount of FIG. 16A.
Figure 17A:
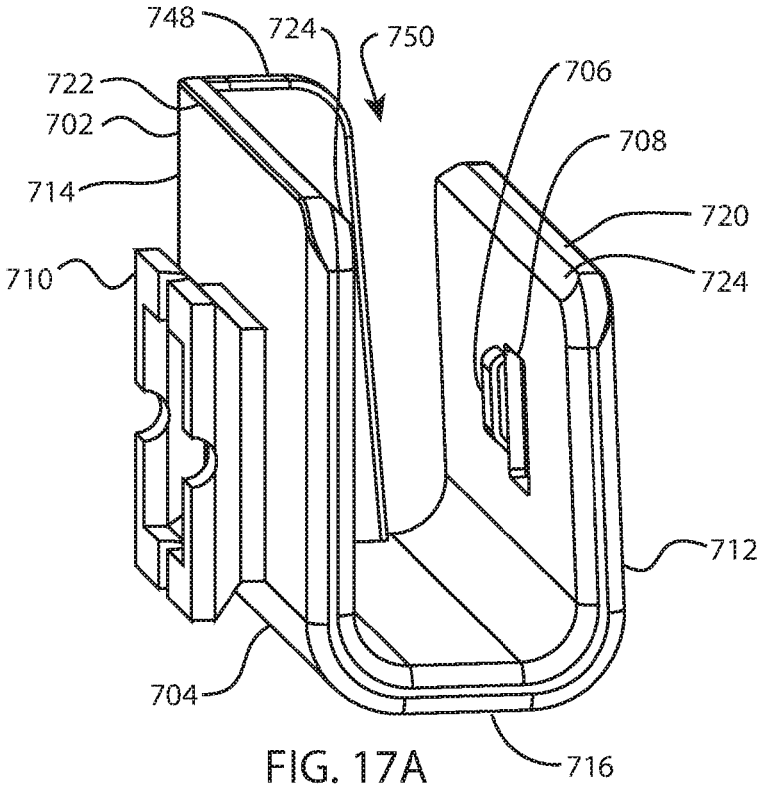
FIG. 17A is a right isometric view of an accessory holder of the accessory mount of FIG. 16A.

Referring to FIGS. 16C and 17A, the accessory holder 702 may include a U-shaped channel 704, a first detent 706, a second detent 708, and a fitting 710.

The U-shaped channel 704 includes a first wall 712 and a second wall 714 opposite to the first wall 712. The second wall 714 may be parallel to the first wall 712, or the second wall 714 may form an acute angle 718 of up to ±45 degrees with the first wall 712. Angle 718 is indicated in FIG. 16C. In this example, angle 718 is non-zero so that the walls 712, 714 converge at their free ends 720, 722. The U-shaped channel 704 has an open side along the free ends 720, 722. The free ends 720, 722 of the first and second walls 712, 714 may include chamfers 724 or another kind of lead-in feature or edge break feature. A third wall 716 may connect the first wall 712 to the second wall 714 opposite the free ends 720, 722. In the illustrated example, the third wall 716 forms generously rounded corners with the first wall 712 and the second wall 714. In other examples, these corners may be sharp, or a full radius may exist between the first wall 712 and the second wall 714.

The accessory holder 702 includes an optional fourth wall 748 which at least partially closes off one of the open ends of the U-shaped channel 704, for example, the end adjacent to the feed lip(s) 56 of the magazine 50 similar to FIGS. 9-10. The fourth wall 748 is connected to the second wall 714 and the third wall 716, but is separated from the first wall 712 by a slot 750. The fourth wall 748 may help the user quickly and properly position the magazine in the accessory holder 702 for secure retention by the first detents 58, 706, and optionally the second detents 60, 708. The slot 750 may permit the first wall 712 to flex to bias the detent 706 to automatically retain and release the magazine 50.

Figure 17B:
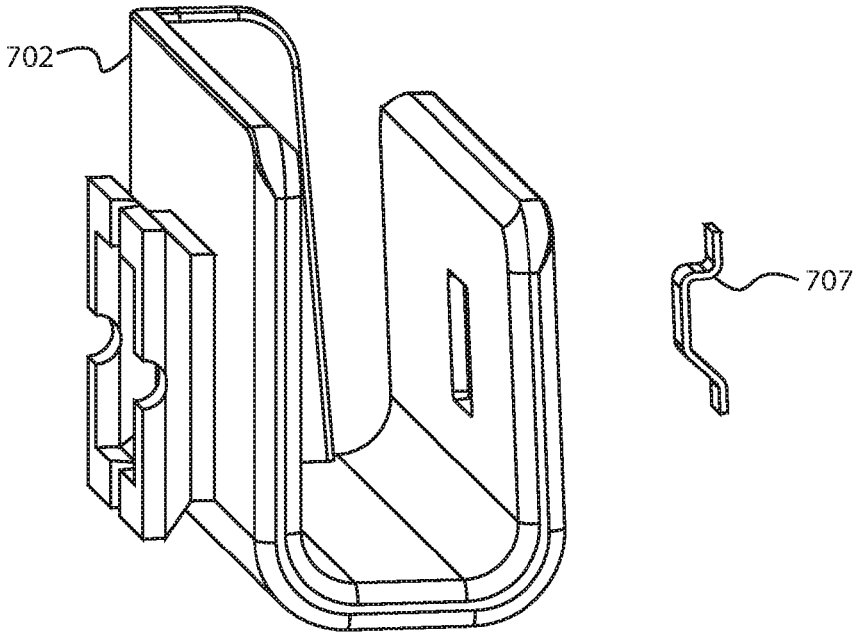
FIG. 17B is an exploded right isometric view of the accessory holder of FIG. 17A.
Figure 18:
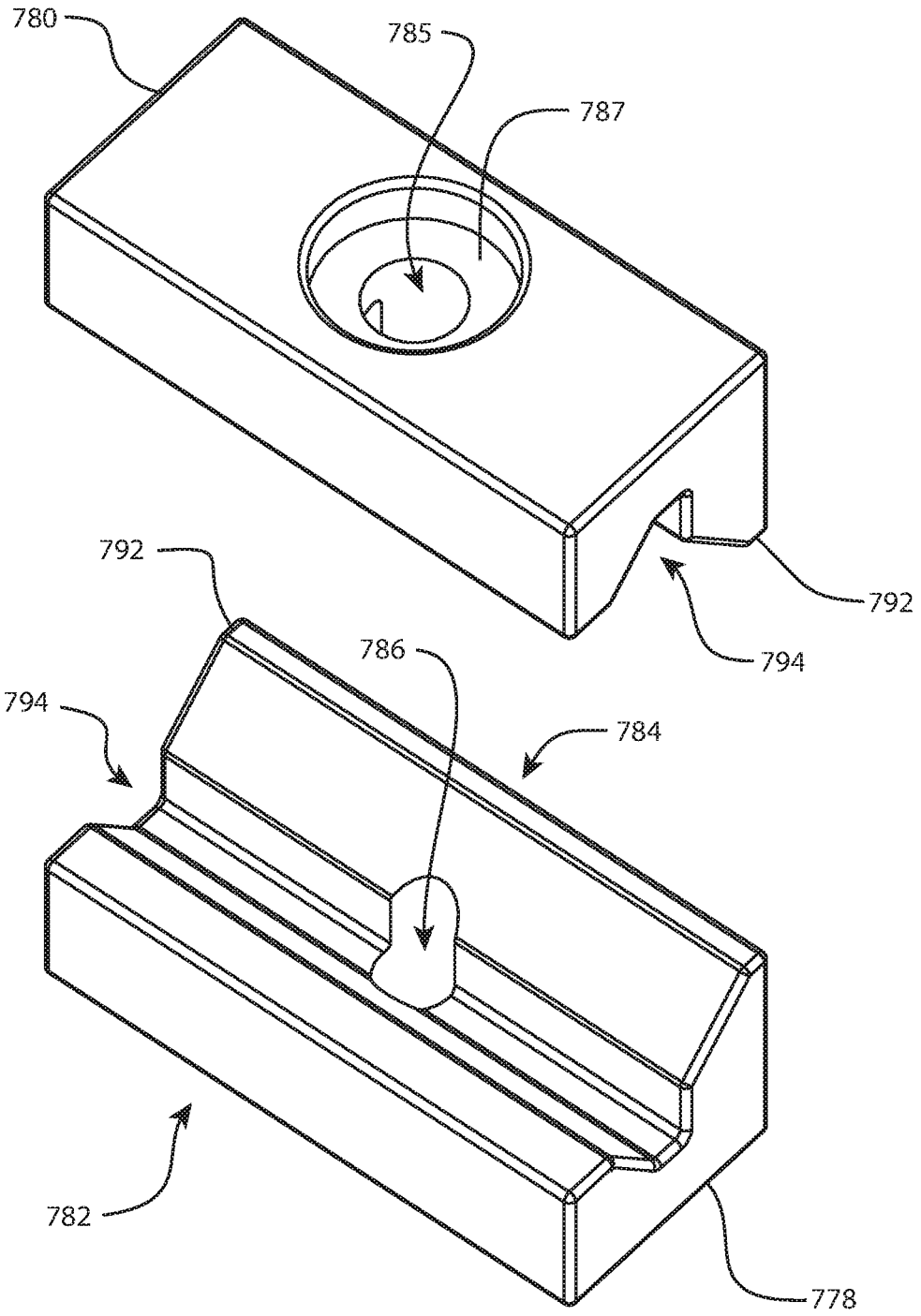
FIG. 18 is an exploded view of a body and a movable jaw of a clamp assembly of the accessory mount of FIG. 16A.

Referring to FIGS. 17A-17B, the first and second detents 706, 708 are located on an interior surface of the first wall 712. The first detent 706 protrudes above the nominal interior surface into the interior space of the U-shaped channel 704 to engage the first detent 58 of the magazine 50, and the second detent 708 is a recess or a hole, although each detent 706, 708 may be a protruding or recessed feature (or a hole).

The first detent 706 is biased to automatically retain the magazine 50 by engaging the first detent 58 when the magazine is introduced into the U-shaped channel 704. The magazine 50 may be retained without direct or indirect user actuation of the first detent 706 (for example, without pressing a button or lever) and may be retained without the user touching the accessory mount 700 at all, only touching the portion of the magazine 50 that protrudes past the accessory mount 700. Bias may be provided by the inherent resilience of the first wall 712 or the U-shaped channel 704, or by a spring element, such as a flat spring or a torsion spring. In an alternate example, the first detent 706 may be bounded on all but one side by a slit (not shown) which separates the first detent 706 from the rest of the first wall 712 so that the first detent 706 is carried on a cantilever tab; in this example, bias may be provided by the inherent resilience of the cantilever tab, or by a spring element that forms the cantilever tab and/or the first detent 706.

The first detent 706 also automatically releases the magazine 50 when the magazine is removed from the U-shaped channel 704. The magazine 50 may be released without direct or indirect user actuation of the first detent 706 (for example, without pressing a button or lever) and may be released without the user touching the accessory mount 700 at all, only touching the portion of the magazine 50 that protrudes past the accessory mount 700.

The first detent 706 may be a separate part such as detent element 707 of FIG. 17B. This arrangement enables the first detent 706 to be made of a different material than the rest of the accessory holder 702. This arrangement also provides clearance under the first detent 706, enhancing its flexibility. The material for detent element 707 may improve its function or reduce its cost. For example, the detent element 707 may be made from a stainless steel alloy chosen for its combination of corrosion resistance, modulus of elasticity, and hardness so that the detent element 707 remains rust free, flexible, and impervious to wear over its service life. The detent element 707 may function as a flat spring. The detent element 707 may be assembled to the accessory holder 702 in many ways; in one example, the detent element 707 is insert molded with a polymer accessory holder 702.

When the magazine 50 is introduced into the U-shaped channel 704, the first detent 706 is received in the first detent 58 and the second detent 60 is received in the second detent 108.

Accessory holder 702 includes a fitting 710 located on an exterior surface of the second wall 714. The fitting 710 may be referred to as an accessory holder fitting or a holder fitting. The fitting 710 illustrates another shape that provides four different discrete rotational positions about axis 742 at zero degrees, 90 degrees, 180 degrees, and 270 degrees. The illustrated shape is a square protrusion that flares or tapers outwardly as it projects from the second wall 714. In an end view (FIG. 16C), the fitting 710 may be described as a dovetail protrusion; this applies in a top view as well. The square shape may be replaced with a polygon of 3, 4, 5, 6 or more sides.

Referring to FIGS. 16A-16C and 18, the clamp assembly 776 includes a body 778, a moveable jaw 780 opposite the body 778, and a fastener 798 extending through the body 778 and the moveable jaw 780. The body 778 includes a first side 782 and an opposite second side 784. In use, the first side 782 faces the exterior surface of the second wall 714 and the second side 784 faces the accessory rail 28. The first side 782 and the second side 784 may also apply to the clamp assembly 776 as a whole, and/or to the moveable jaw 780.

A complementary second fitting 788, or clamp fitting, extends into the body 778 and the movable jaw 780 from the first side 782, with half of the second fitting 788 formed in the body 778 and half formed in the movable jaw 780. Each half of the second fitting 788 includes a tooth 768 which extends toward the opposite half of the second fitting, and an adjacent groove 770, or recess, which extends away from the opposite half of the second fitting. The complementary second fitting 788 is shaped and sized for complementary engagement with the fitting 710, as best seen in FIG. 16C. Since the illustrated fitting 710 is a flared square protrusion or dovetail protrusion, the illustrated complementary second fitting 788 is a dovetail shape or an undercut cavity. In use, the illustrated fitting 710 is received in and clamped by the complementary second fitting 788, in any one of the four rotational positions.

The second side 784 of the body 778 includes a fixed jaw 790 and carries the movable jaw 780 opposite to, and facing, the fixed jaw. The movable jaw 780 may be secured to the body 778 with the fastener 798. The fastener 798 may extend through a non-threaded hole 785 through the movable jaw 780; an optional counterbore 787 may surround the hole 785 to receive a head of the fastener 798. The fastener 798 may thread into a threaded hole 786 in the body 778. The fastener 798 may be spring biased to urge the movable jaw 780 toward the fixed jaw 790 and simultaneously close the second fitting 788. The fastener 798 may also fix or lock the movable jaw 780 relative to the fixed jaw 790 and simultaneously lock the second fitting 788. Each jaw 780, 790 includes a tooth 792 which extends toward the opposite jaw, and an adjacent groove 794, or recess, which extends away from the opposite jaw. Thus the overall configuration of the fixed and movable jaws 780, 790 in their operative arrangement provides a T-shape, dovetail shape, or undercut cavity 796, or rail fitting 796, on the second side 784 of the body 778 of the clamp assembly 776. The undercut cavity 796 receives the accessory rail 28 to couple the clamp assembly 776 to the accessory rail, while the fastener 798 locks the movable jaw 780 relative to the fixed jaw 790 to lock the clamp assembly 776 to the accessory rail. Referring to FIG. 16A, it will be appreciated that teeth 792 are closer together than teeth 768 when the clamp assembly 776 is coupled and locked to the accessory holder 702. Thus, clamp assembly 776 couples a wider dovetail protrusion (fitting 710) to a narrower dovetail protrusion (accessory rail 28 of FIG. 1).

Figure 19A:
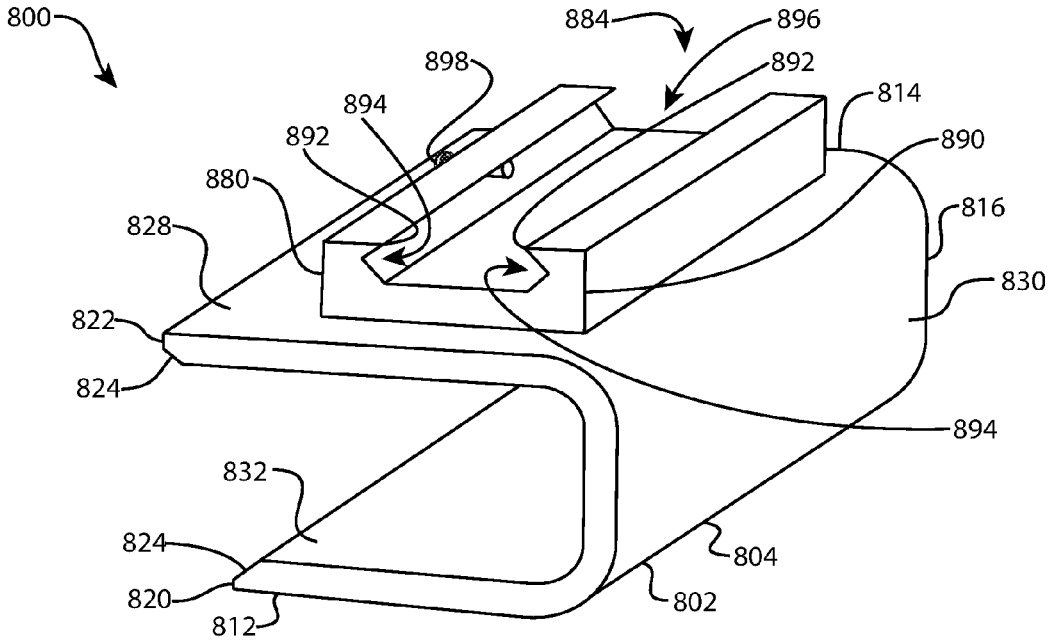
FIG. 19A is a right isometric view of yet another accessory mount.
Figure 19B:
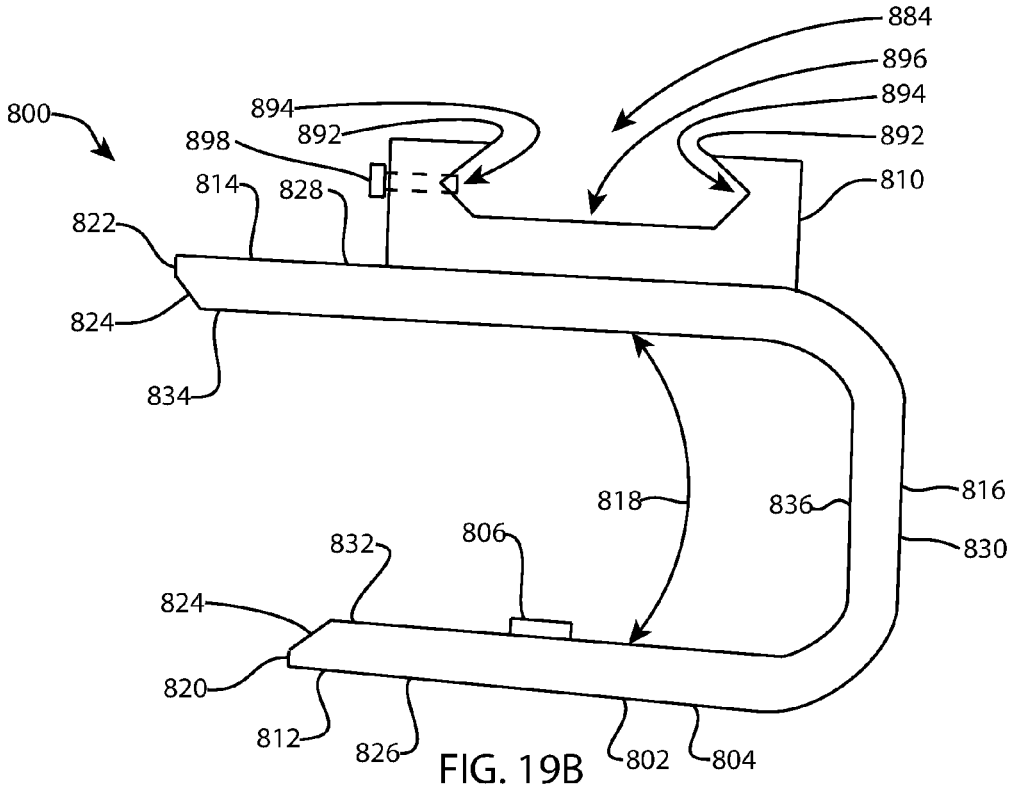
FIG. 19B is an end view of the accessory mount of FIG. 19A.

Referring to FIGS. 19A and 19B, yet another accessory mount 800 includes an accessory holder 802 and a fastener 898. The accessory holder 802 may include a U-shaped channel 804, a first detent 806, a fitting 810, a first wall 812, a second wall 814, a third wall 816, an angle 818 between the first wall 812 and the second wall 814, and chamfers 824, all of which may be as described for accessory mount 100. While the accessory holder 802 is not shown with features comparable to second detent 108, first reinforcement 138, second reinforcement 140, fitting axis 142, fitting hole 144, pocket 146, fourth wall 148, slot 150, flaring portions 252, 254, corrugated section 256, angled flat section 258, or notch 260, any or all of these features, as described elsewhere herein, may be included in accessory holder 802.

The accessory holder 802 may include a U-shaped channel 804, a first detent 806, and a fitting 810.

The U-shaped channel 804 includes a first wall 812 and a second wall 814 opposite to the first wall 812. The second wall 814 may be parallel to the first wall 812, or the second wall 814 may form an acute angle 818 of up to ±45 degrees with the first wall 812. Angle 818 is indicated in FIG. 19B. In this example, angle 818 is non-zero and opens toward a third wall 816 so that the walls 812, 814 converge at their free ends 820, 822. The U-shaped channel 804 has an open side along the free ends 820, 822. The free ends 820, 822 of the first and second walls 812, 814 may include chamfers 824 or another kind of lead-in feature or edge break feature. The third wall 816 may connect the first wall 812 to the second wall 814 opposite the free ends 820, 822. In the illustrated example, the third wall 816 forms generously rounded corners with the first wall 812 and the second wall 814. In other examples, these corners may be sharp, or a full radius may exist between the first wall 812 and the second wall 814.

The first detent 806 is located on an interior surface of the first wall 812. The first detent 806 protrudes above the nominal interior surface into the interior space of the U-shaped channel 804 to engage the first detent 58 of the magazine 50, although the first detent 806 may be a protruding or recessed feature (or a hole).

The first detent 806 is biased to automatically retain the magazine 50 by engaging the first detent 58 when the magazine is introduced into the U-shaped channel 804. The magazine 50 may be retained without direct or indirect user actuation of the first detent 806 (for example, without pressing a button or lever) and may be retained without the user touching the accessory mount 800 at all, only touching the portion of the magazine 50 that protrudes past the accessory mount 800. Bias may be provided by the inherent resilience of the first wall 812 or the U-shaped channel 804, or by a spring element, such as a flat spring or a torsion spring. In an alternate example, the first detent 806 may be bounded on all but one side by a slit (not shown) which separates the first detent 806 from the rest of the first wall 812 so that the first detent 806 is carried on a cantilever tab; in this example, bias may be provided by the inherent resilience of the cantilever tab, or by a spring element that forms the cantilever tab and/or the first detent 806.

The first detent 806 also automatically releases the magazine 50 when the magazine is removed from the U-shaped channel 804. The magazine 50 may be released without direct or indirect user actuation of the first detent 806 (for example, without pressing a button or lever) and may be released without the user touching the accessory mount 800 at all, only touching the portion of the magazine 50 that protrudes past the accessory mount 800.

The fitting 810 in this example couples directly to the accessory rail 28 of the firearm 10 to provide two mounting orientations 180 degrees apart. The fitting 810 includes some features of the clamp assemblies 176, 776 described above, and may be described as a clamp as well as a fitting. The fitting includes a second side 884 (or rail-facing side) which includes a first fixed jaw 880 and a second fixed jaw 890. The first fixed jaw 880 is opposite to, and facing, the second fixed jaw 890. Each jaw 880, 890 includes a tooth 892 which extends toward the opposite jaw, and an adjacent groove 894, or recess, which extends away from the opposite jaw. Thus the overall configuration of the first and second fixed jaws 880, 890 provides a T-shape, dovetail shape, or undercut cavity 896 on the second side 884 of the fitting 810.

Any of the apparatus described herein may be made from metal, metal alloy, plastic, polymer, resin, ceramic, glass, nonmetal mineral, wood, paper, or composite material.

Component parts within an assembly may be made of different materials. Different materials may be used within a single part, each material selected for suitable performance characteristics at its location. The accessory mounts 100, 200, 300, 400, 500, 600, 700, and clamp assemblies 176, 776, or portions thereof, may be made of plastic or polymer, such as acrylonitrile butadiene styrene (ABS), cyanate esters and polycyanurates, epoxy resin and particle- or fiber-reinforced epoxy resin, fiber reinforced thermosetting plastic such as duroplast, melamine resin, nylon 6, nylon 6-6, phenol-formaldehyde resin such as bakelite, polyamides (PA), polybutylene terephthalate (PBT), polycarbonates, polyester resins and polyester fiberglass systems, polyetheretherketone (PEEK), polyetherketone (PEK), polyethylene terephthalate (PET), polyimides, polyoxymethylene plastic (POM/Acetal), polyphenylene oxide (PPO), polyphenylene sulfide (PPS), polysulphone (PSU), polytetrafluoroethylene (PTFE/Teflon), polyurethanes and polyurethane polymers, ultra-high-molecular-weight polyethylene (UHMWPE/UHMW), urea-formaldehyde foam, or vulcanized rubber. The accessory mounts 100, 200, 300, 400, 500, 600, 700, and clamp assemblies 176, 776, or portions thereof, may also be made from metal or metal alloy, and may be particularly suited to sheet metal fabrication techniques.

The methods of use disclosed herein are based on a sequence of steps that may include providing a firearm, an accessory for the firearm, and/or an accessory mount; coupling the accessory mount to the firearm; coupling the accessory to the accessory mount; and, optionally, decoupling the accessory from the accessory mount. The steps of coupling and decoupling the accessory and the accessory mount may be performed with only one hand, and may be performed while grasping only the portion of the accessory that protrudes from the accessory mount, without directly touching or actuating the accessory mount. While the following methods are described in the context of using the accessory holders as spare magazine holders, it will be appreciated that these methods are adaptable to other uses of the accessory holder.

Coupling the accessory mount to the firearm 10 may include directly or indirectly coupling and/or locking an exterior surface of the accessory holder to the accessory rail 28 of the firearm 10. Coupling the accessory mount 100 to the firearm 10 may include coupling the accessory holder 102, the clamp assembly 176, and the accessory rail 28 of the firearm 10 together. The accessory holder 102 may first be coupled to the clamp assembly 176, then the clamp assembly 176 with attached accessory holder 102 may be coupled to the accessory rail 28 of the firearm 10; or the clamp assembly 176 may first be coupled to the accessory rail 28 of the firearm 10, then the clamp assembly 176 with attached accessory rail 28 of the firearm 10 may be coupled to the accessory holder 102. Coupling the accessory mount 200, 300, 400, 500, or 600 to the firearm 10 may include the same steps. Coupling the accessory mount 700 to the firearm 10 may include the same steps, or the step of coupling the accessory holder 702, the clamp assembly 776, and the accessory rail 28 of the firearm 10 together simultaneously. Coupling the accessory mount 800 to the firearm 10 may include coupling the accessory holder 802 and the accessory rail 28 of the firearm 10 together. The undercut cavity 896 of the accessory holder 802 may slide over the accessory rail 28 and the fastener 898 may lock the accessory holder 802 in a desired location along the accessory rail 28. The accessory mount 100, 200, 300, 400, 500, 600, 700, or 800 may be coupled to the top side, bottom side, left side, right side, front side, back side, or to another location of the firearm 10.

The accessory holder 102 may be coupled to the clamp assembly 176 by aligning the holder fitting 110 of the accessory holder 102 with the complementary clamp fitting 188 of the clamp assembly 176 in one of the rotational positions provided by the shapes of the holder fitting 110 and the complementary clamp fitting 188, sliding the holder fitting 110 of the accessory holder 102 into engagement with the complementary clamp fitting 188 of the clamp assembly 176, and securing the accessory holder 102 to the clamp assembly 176 with the fastener 2. Securing the accessory holder 102 to the clamp assembly 176 with the fastener 2 may include passing the threaded shaft 6 of the fastener 2 through the hole 144 in the holder fitting 110 of the accessory holder 102 and threading the threaded shaft 6 into the threaded hole 186 of the clamp body 178 until the accessory holder 102 is fixed to the clamp assembly 176. The head 4 of the fastener 2 may come to rest in the pocket 146 of the accessory holder 102, if present. Coupling the accessory holder 202, 302, 402, 502, or 602 to the clamp assembly 176 and/or securing the accessory holder 202, 302, 402, 502, or 602 to the clamp assembly 176 with the fastener 2 may include the same steps. The accessory holder 702 may be coupled to the clamp assembly 776 by aligning the holder fitting 710 of the accessory holder 702 with the complementary clamp fitting 788 of the clamp assembly 776 in one of the rotational positions provided by the shapes of the holder fitting 710 and the complementary clamp fitting 788, sliding the holder fitting 710 of the accessory holder 702 into engagement with the complementary clamp fitting 788 of the clamp assembly 776, and securing the accessory holder 702 to the clamp assembly 776 with the fastener 798. Securing the accessory holder 702 to the clamp assembly 776 with the fastener 798 may include passing the fastener 798 through the non-threaded hole 785 through the movable jaw 780 and threading the fastener 798 into the threaded hole 786 in the body 778. The accessory holder 802 may be coupled to the clamp 810 by being integrally formed with the clamp 810, or by being secured to the clamp 810 by fastener 2.

Optionally, the rotational position of the accessory holder 102 relative to the clamp assembly 176 may be changed by loosening the fastener 2, disengaging the holder fitting 110 of the accessory holder 102 and the complementary clamp fitting 188 of the clamp assembly 176, rotating the accessory holder 102 to a different rotational position, re-engaging the holder fitting 110 of the accessory holder 102 and the complementary clamp fitting 188 of the clamp assembly 176, and re-tightening the fastener 2. The fastener 2 need not be removed entirely from the accessory holder 102 and the clamp assembly 176, just loosened enough to disengage the holder fitting 110 of the accessory holder 102 and the complementary clamp fitting 188 of the clamp assembly 176. The rotational position of the accessory holder 202, 302, 402, 502, or 602 relative to the clamp assembly 176 may be changed following the same steps. The rotational position of the accessory holder 702 relative to the clamp assembly 776 may be changed following the same steps, loosening and tightening fastener 798. The rotational position of the accessory holder 802 is fixed relative to the clamp 810.

The clamp assembly 176 may be coupled to the accessory rail 28 of the firearm 10 by urging the movable jaw 180 of the clamp assembly 176 away from the fixed jaw 190 of the clamp assembly 176, receiving a portion of the accessory rail 28 in the undercut cavity 196 of the clamp assembly 176, urging the movable jaw 180 of the clamp assembly 176 toward the fixed jaw 190 of the clamp assembly 176 to grip the accessory rail 28 between the movable jaw 180 and the fixed jaw 190, and locking the movable jaw 180 relative to the fixed jaw 190 by tightening the fastener 198 so that the clamp assembly 176 is fixed to the accessory rail 28. Coupling the clamp assembly 776 to the accessory rail 28 may include the same steps. Coupling the clamp 810 to the accessory rail 28 may include sliding at least a portion of the accessory rail 28 into the undercut cavity 896 and tightening the fastener 898 against the accessory rail 28. Optionally, coupling the clamp assembly 176 to the accessory rail 28 may also involve threading the threaded shaft 6 of the fastener 2 through the threaded hole 186 of the clamp body 178 and into the groove 32 of the accessory rail 28 until the fastener 2 directly abuts the accessory rail 28. The head 4 of the fastener 2 may come to rest in the pocket 146 of the accessory mount 100, if present.

Optionally, the clamp assembly 176 may be repositioned along the accessory rail 28 by unlocking the movable jaw 180, sliding the clamp assembly 176 along the accessory rail 28 to a new position, and locking the movable jaw 180 again. Repositioning the clamp assembly 776 along the accessory rail 28 may include the same steps. Optionally, repositioning the clamp assembly 176 along the accessory rail 28 may include loosening the fastener 2 between the accessory holder 102 and the clamp body 178. The fastener 2 need not be removed entirely from the accessory holder 102 and the clamp assembly 176, just loosened enough to clear the ridges of the accessory rail 28, which may involve retracting the threaded shaft 6 of the fastener 2 within the body 178 of the clamp assembly 176. These steps may be performed with the clamp assembly 176 and accessory holder 202, 302, 402, 502, or 602.

Coupling the accessory, magazine 50, to the accessory mount 100 may include sliding the accessory, magazine 50, into the accessory holder 102 until the first detent 58 of the accessory, magazine 50, engages the complementary first detent 106 of the accessory holder 102. The accessory, magazine 50, may slide along any path to reach engagement of the first detent 58 of the accessory, magazine 50, and the complementary first detent 106 of the accessory holder 102. For example, the accessory, magazine 50, may slide between the first and second walls 112, 114 while contacting the third wall 116 or fourth wall 148. This procedure may include aligning the first detent 58 with the first detent 106 before sliding the accessory, magazine 50, into the accessory holder 102, particularly if the mutual first detents 58, 106 are arranged for only one operational orientation between the accessory, magazine 50, and the accessory holder 102. Optionally, coupling the accessory, magazine 50, to the accessory mount 100 may include sliding the accessory, magazine 50, into the accessory holder 102 until the second detent 60 of the accessory, magazine 50, engages the complementary second detent 108 of the accessory holder 102. The accessory, magazine 50, may slide along any path to reach engagement of the second detent 60 and the complementary second detent 108. This procedure may include aligning the second detent 60 with the second detent 108 before sliding the accessory, magazine 50, into the accessory holder 102. This procedure, including the optional steps, may be performed with one hand without directly touching the accessory mount 100, only touching the portion of the accessory, magazine 50, that protrudes beyond the accessory mount 100. Coupling the accessory, magazine 50, to the accessory mount 200, 300, 400, 500, 600, 700, or 800 may include the same steps, modified according to the various detents described herein for the magazine 50 and the various accessory mounts.

Decoupling the accessory, magazine 50, from the accessory mount 100 may include sliding the accessory, magazine 50, out of the accessory holder 102. Sliding the accessory, magazine 50, out of the accessory holder 102 may include moving the first detent 58 of the accessory, magazine 50, out of engagement with the first detent 106 of the accessory holder 102, which may involve pulling on and/or rotating the accessory, magazine 50, relative to the accessory holder 102. Rotating the accessory, magazine 50, relative to the accessory holder 102 may involve levering the accessory, magazine 50, out from between the first and second walls 112, 114 against the resistance of the third wall 116 or fourth wall 148. Optionally, sliding the accessory, magazine 50, out of the accessory holder 102 may include moving the second detent 60 of the accessory, magazine 50, out of engagement with the second detent 108 of the accessory holder 102. This procedure, including the optional steps, may be performed with one hand without directly touching the accessory mount 100, only the portion of the accessory, magazine 50, that protrudes beyond the accessory mount 100. Decoupling the accessory, magazine 50, from the accessory mount 200, 300, 400, 500, 600, 700, or 800 may include the same steps, modified according to the various detents described herein for the magazine 50 and the various accessory mounts.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim in this or any application claiming priority to this application require more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. Elements recited in means-plus-function format are intended to be construed in accordance with 35 U.S.C. §112 Para. 6. It will be apparent to those having skill in the art that changes may be made to the details of the above-described embodiments without departing from the underlying principles of the technology.

While specific embodiments and applications of the present technology have been illustrated and described, it is to be understood that the technology is not limited to the precise configuration and components disclosed herein. Various modifications, changes, and variations which will be apparent to those skilled in the art may be made in the arrangement, operation, and details of the methods and systems of the present technology disclosed herein without departing from the spirit and scope of the technology.

The invention claimed is:

1. A system for mounting an accessory on an accessory rail of a firearm, comprising:

an accessory holder, wherein the accessory holder comprises a U-shaped channel, wherein the U-shaped channel comprises a first wall, a second wall opposite to the first wall, a third wall connecting the first wall to the second wall, a fourth wall, an open side opposite to the third wall, an open first end adjacent to the third wall and the open side, and a second end opposite to the open first end, wherein an interior surface of the first wall carries a first detent, wherein an exterior surface of the second wall couples to the accessory rail and locks to the accessory rail, wherein the fourth wall closes off at least a portion of the second end, wherein the fourth wall is separated from the first wall by a slot;

wherein the U-shaped channel receives the accessory, wherein the first detent retains the accessory in the U-shaped channel, wherein, when the U-shaped channel receives the accessory, the first detent engages a complementary second detent of the accessory and a first side of the accessory is completely exposed through the open side.

2. The system of claim 1, wherein the second wall is parallel to the first wall.

3. The system of claim 1, wherein the first wall and the second wall each have a free end opposite to the third wall, wherein the second wall forms an acute angle with the first wall, wherein the acute angle opens toward the third wall so that the free ends of the first and second walls converge.

4. The system of claim 1, wherein the first detent protrudes into an interior space of the U-shaped channel.

5. The system of claim 1, wherein the accessory is a magazine;

wherein, when the U-shaped channel receives the magazine, a feed lip of the magazine is adjacent to the fourth wall.

6. The system of claim 1, wherein the exterior surface of the second wall carries a clamp, wherein the clamp receives the accessory rail and locks the accessory holder to the accessory rail.

7. The system of claim 6, wherein the exterior surface of the second wall comprises a holder fitting, wherein the holder fitting comprises a central axis, wherein the clamp comprises a first side that faces the holder fitting, wherein the first side of the clamp comprises a clamp fitting which is complementary to the holder fitting, wherein the clamp fitting fixedly couples to the holder fitting in at least three discrete rotational positions about the central axis of the holder fitting.

8. The system of claim 7, wherein the at least three discrete rotational positions are at 90 degree intervals.

9. The system of claim 7, wherein the holder fitting comprises an outwardly flared square protrusion, wherein the clamp fitting comprises a first tooth and a second tooth opposite to the first tooth, wherein the outwardly flared square protrusion is received between the first and second teeth.

10. The system of claim 9, wherein the clamp comprises a second side that faces the accessory rail, wherein the second side of the clamp comprises a rail fitting which is complementary to the accessory rail, wherein the rail fitting receives the accessory rail and locks the clamp to the accessory rail.

11. The system of claim 10, wherein the rail fitting comprises a third tooth and a fourth tooth opposite to the third tooth, wherein the accessory rail is received between the third and fourth teeth, wherein, when the outwardly flared square protrusion is received and locked between the first and second teeth, a distance between the first and second teeth is greater than a distance between the third and fourth teeth.

12. A system for mounting an accessory on an accessory rail of a firearm, comprising:

an accessory holder, wherein the accessory holder comprises a U-shaped channel, wherein the U-shaped channel comprises a first wall, a second wall opposite to the first wall, a third wall connecting the first wall to the second wall, an open side opposite to the third wall, an open first end adjacent to the third wall and the open side, and a second end opposite to the open first end, wherein an interior surface of the U-shaped channel carries a first detent, wherein an exterior surface of the U-shaped channel carries a clamp, wherein the clamp receives the accessory rail and locks the accessory holder to the accessory rail, wherein the exterior surface of the U-shaped channel comprises a holder fitting, wherein the holder fitting comprises a central axis, wherein the clamp comprises a first side that faces the holder fitting, wherein the first side of the clamp comprises a clamp fitting which is complementary to the holder fitting, wherein the clamp fitting fixedly couples to the holder fitting in at least three discrete rotational positions about the central axis of the holder fitting;

wherein the U-shaped channel receives the accessory, wherein the first detent retains the accessory in the U-shaped channel, wherein, when the U-shaped channel receives the accessory, a first side of the accessory is completely exposed through the open side.

13. The system of claim 12, wherein the second wall is parallel to the first wall.

14. The system of claim 12, wherein the first wall and the second wall each have a free end opposite to the third wall, wherein the second wall forms an acute angle with the first wall, wherein the acute angle opens toward the third wall so that the free ends of the first and second walls converge.

15. The system of claim 12, wherein the first detent protrudes into an interior space of the U-shaped channel.

16. The system of claim 12, wherein the U-shaped channel comprises a fourth wall, wherein the fourth wall closes off at least a portion of the second end, wherein the fourth wall is separated from the first wall by a slot.

17. The system of claim 16, wherein the accessory is a magazine;

wherein, when the U-shaped channel receives the magazine, a feed lip of the magazine is adjacent to the fourth wall.

18. The system of claim 12, wherein the at least three discrete rotational positions are at 90 degree intervals.

19. The system of claim 12, wherein the holder fitting comprises an outwardly flared square protrusion, wherein the clamp fitting comprises a first tooth and a second tooth opposite to the first tooth, wherein the outwardly flared square protrusion is received between the first and second teeth.

20. The system of claim 19, wherein the clamp comprises a second side that faces the accessory rail, wherein the second side of the clamp comprises a rail fitting which is complementary to the accessory rail, wherein the rail fitting receives the accessory rail and locks the clamp to the accessory rail.

21. The system of claim 20, wherein the rail fitting comprises a third tooth and a fourth tooth opposite to the third tooth, wherein the accessory rail is received between the third and fourth teeth, wherein, when the outwardly flared square protrusion is received and locked between the first and second teeth, a distance between the first and second teeth is greater than a distance between the third and fourth teeth.

22. A system for mounting an accessory on an accessory rail of a firearm, comprising:

an accessory holder, wherein the accessory holder comprises a U-shaped channel, wherein the U-shaped channel comprises a first wall, a second wall opposite to the first wall, a third wall connecting the first wall to the second wall, a fourth wall, an open side opposite to the third wall, an open first end adjacent to the third wall and the open side, and a second end opposite to the open first end, wherein the first wall and the second wall each have a free end opposite to the third wall, wherein the U-shaped channel carries a first detent, wherein an exterior surface of the U-shaped channel couples to the accessory rail, wherein the fourth wall closes off at least a portion of the second end, wherein the fourth wall is separated from the first wall by a slot;

wherein the U-shaped channel receives the accessory, wherein the first detent retains the accessory in the U-shaped channel, wherein, when the U-shaped channel receives the accessory, the first detent engages a complementary second detent of the accessory and a first side of the accessory is completely exposed through the open side.

23. The system of claim 22, wherein the second wall is parallel to the first wall.

24. The system of claim 22, wherein the second wall forms an acute angle with the first wall, wherein the acute angle opens toward the third wall so that the free ends of the first and second walls converge.

25. The system of claim 22, wherein an interior surface of the U-shaped channel carries the first detent, wherein the first detent protrudes into an interior space of the U-shaped channel.

26. The system of claim 22, wherein the open side extends between the free ends of the first and second walls.

27. The system of claim 26, wherein the accessory is a magazine;

wherein, when the U-shaped channel receives the magazine, a feed lip of the magazine is adjacent to the fourth wall.

28. The system of claim 22, wherein the exterior surface of the U-shaped channel carries a clamp, wherein the clamp receives the accessory rail and locks the accessory holder to the accessory rail.

29. The system of claim 28, wherein the exterior surface of the U-shaped channel comprises a holder fitting, wherein the holder fitting comprises a central axis, wherein the clamp comprises a first side that faces the holder fitting, wherein the first side of the clamp comprises a clamp fitting which is complementary to the holder fitting, wherein the clamp fitting fixedly couples to the holder fitting in at least three discrete rotational positions about the central axis of the holder fitting.

30. The system of claim 29, wherein the at least three discrete rotational positions are at 90 degree intervals.

31. The system of claim 29, wherein the holder fitting comprises an outwardly flared square protrusion, wherein the clamp fitting comprises a first tooth and a second tooth opposite to the first tooth, wherein the outwardly flared square protrusion is received between the first and second teeth.

32. The system of claim 31, wherein the clamp comprises a second side that faces the accessory rail, wherein the second side of the clamp comprises a rail fitting which is complementary to the accessory rail, wherein the rail fitting receives the accessory rail and locks the clamp to the accessory rail.

33. The system of claim 32, wherein the rail fitting comprises a third tooth and a fourth tooth opposite to the third tooth, wherein the accessory rail is received between the third and fourth teeth, wherein, when the outwardly flared square protrusion is received and locked between the first and second teeth, a distance between the first and second teeth is greater than a distance between the third and fourth teeth.

34. The system of claim 1, wherein the fourth wall is connected to the second and third walls.

35. The system of claim 32, wherein the fourth wall is connected to the second and third walls.

* * * * *